US008454405B2

(12) United States Patent
Scarborough

(10) Patent No.: US 8,454,405 B2
(45) Date of Patent: Jun. 4, 2013

(54) FLYING TOY HAVING GYROSCOPIC AND GLIDING COMPONENTS

(76) Inventor: Guy L. Scarborough, Woodstock, GA (US)

( * ) Notice: Subject to any disclaimer, the term of this patent is extended or adjusted under 35 U.S.C. 154(b) by 0 days.

(21) Appl. No.: 13/428,048

(22) Filed: Mar. 23, 2012

(65) Prior Publication Data

US 2012/0214379 A1 Aug. 23, 2012

Related U.S. Application Data

(62) Division of application No. 12/592,288, filed on Nov. 20, 2009, now Pat. No. 8,182,306.

(60) Provisional application No. 61/116,509, filed on Nov. 20, 2008.

(51) Int. Cl.
*A63H 27/00* (2006.01)

(52) U.S. Cl.
USPC ..... 446/46; 446/36; 446/34; 446/61; 244/23 C; 244/12.2; 244/39

(58) Field of Classification Search
USPC ..... 446/36–48, 61–68; 244/23 C, 12.2, 244/39
See application file for complete search history.

(56) References Cited

U.S. PATENT DOCUMENTS 2,659,178 A * 11/1953 Van Hartesveldt ..... 446/46
3,553,884 A * 1/1971 Dunstan ..... 446/64
3,675,926 A * 7/1972 Misevich ..... 273/362
4,077,155 A * 3/1978 Bruntmyer ..... 446/46
4,153,252 A * 5/1979 Sullivan ..... 473/588
4,171,704 A * 10/1979 Sarkis ..... 131/178
4,209,936 A * 7/1980 Sklar ..... 446/46
4,335,537 A * 6/1982 Walker ..... 446/36
4,436,264 A * 3/1984 Brumfield ..... 244/153 R
4,515,570 A * 5/1985 Beltran ..... 446/47
4,846,749 A * 7/1989 Petko ..... 446/36
4,955,842 A * 9/1990 Marcotti ..... 446/46
5,055,080 A * 10/1991 Cwalinski et al. ..... 446/46
D326,121 S * 5/1992 Asner ..... D21/443
5,259,802 A * 11/1993 Yang ..... 446/48
5,275,417 A * 1/1994 Seymour ..... 273/330
5,324,223 A * 6/1994 Yang ..... 446/46
5,520,565 A * 5/1996 Ulysse ..... 446/46
5,934,966 A * 8/1999 Ward ..... 446/46
6,106,355 A * 8/2000 Hoerner ..... 446/46
6,200,185 B1 * 3/2001 Kuster, Jr. ..... 446/47
6,435,932 B1 * 8/2002 Lynn ..... 446/30

(Continued)

*Primary Examiner* — Alvin Hunter
*Assistant Examiner* — Matthew B Stanczak
(74) *Attorney, Agent, or Firm* — Alston & Bird LLP

(57) ABSTRACT

Provided are flying devices and methods of manufacturing and launching same, in particular flying toys or other recreational items that are designed to be thrown through the air by a user participating in any one of a variety of throwing (i.e. "catch") games. In particular, the concept is directed toward a flying disc having rotatably attached non-rotating (a.k.a. "gliding") portions that are attached to the disc and provide an optical illusion, wherein the user (and, similarly, an observer) does not notice the spinning of the flying disc, but instead sees a flying craft that appears to have no propulsion, yet flies. While the non-rotating portions alter the airflow associated with a typical flying disc, they do not negatively affect the flight characteristics of the disc itself. Indeed, in certain embodiments, the non-rotating portions (e.g., ailerons) have been observed to improve the flight characteristics of typical flying discs.

5 Claims, 15 Drawing Sheets

U.S. PATENT DOCUMENTS

| | | | | |
|---|---|---|---|---|
| 6,450,446 | B1 * | 9/2002 | Holben | 244/34 A |
| 6,450,852 | B1 * | 9/2002 | Arredondo | 446/61 |
| 6,695,666 | B2 * | 2/2004 | Nikonorov | 446/46 |
| 7,682,214 | B2 * | 3/2010 | Barniak, Jr. | 446/46 |
| 8,182,306 | B2 * | 5/2012 | Scarborough | 446/46 |
| 2008/0125001 | A1 * | 5/2008 | Barniak | 446/46 |
| 2009/0305599 | A1 * | 12/2009 | Newton et al. | 446/61 |
| 2010/0062676 | A1 * | 3/2010 | Tong | 446/46 |

* cited by examiner

FLYING TOY HAVING GYROSCOPIC AND GLIDING COMPONENTS

CROSS REFERENCE TO RELATED APPLICATIONS

This application is a divisional of U.S. application Ser. No. 12/592,288, filed Nov. 20, 2009, which claims the benefit of U.S. Provisional Patent Application Ser. No. 61/116,509, filed Nov. 20, 2008, all of which are incorporated herein in their entirety.

BACKGROUND OF THE INVENTION

1. Field of the Invention

The general concept is directed towards aerodynamic toys that are designed to be thrown through the air by a user participating in any one of a variety of recreational throwing (i.e. "catch") games.

2. Prior Art

Over the past fifty years, toys resembling discs or saucers have enjoyed great popularity as recreational items for use in throwing games and contests. In the typical embodiment, such toys have been made of a plastic material in a circular configuration with a rim portion located at its periphery. Such devices are commonly known and commercially available (i.e., for example, Frisbee brand discs, similar to that described in greater detail in U.S. Pat. No. 3,724,122). Over the past two decades, a variety of improvements have been made to this well-known flying device, typically by providing non-rotating attachments of some sort to the disc or saucer itself. For example, some of these devices, such as that described in greater detail in U.S. Pat. No. 6,695,666, have provided a streamer, windsock, or the like for aesthetically enhancing the visual effect of the flying disc toy while in flight. Other devices, such as that described in greater detail in U.S. Pat. No. 5,324,223, have provided model aircraft (or other similar non-rotating items) pivotally coupled to the flying disc.

Such prior art devices have included deficiencies that have negatively affected the flight characteristics of the flying disc itself. Many such devices have experienced stalling problems due to the additional weight of the peripheral, non-rotating items affixed to the disc. Such stalling problems typically arise because the additional weight of the non-rotating items alters the center of gravity for the gyroscopic flying disc in such a way that detracts from the disc's ability to remain horizontally oriented during flight. This altered center of gravity causes the flying disc to become unstable (i.e., to wobble, rotate unevenly, turn downward toward the ground, etc.). As a result, the ability of the device to fly is severely impacted by the additional, off-centered weight of the non-rotating items.

Some prior art devices have also experienced yaw problems (i.e. the disc turning or flipping over during flight) due to a combination of the additional torque and drag invariably introduced by the presence of the non-rotating items and/or the methods used to affix the items to the disc. For example, many prior art attachment mechanisms, if placed in contact with the flying disc itself, produces frictional drag between the pin and the rotating disc, thereby reducing the spin speed of the disc. Reduced spin speed results in diminished flight characteristics. Similarly, many prior art attachment mechanisms produce a torque that alters the gyroscopic balance of the disc itself, thereby causing the disc to veer to one side or another and to even, in some instances, to flip over and crash into the ground.

Overall, as discussed above, many of the prior art devices while aesthetically viable, functioned poorly and exhibited flight problems that detracted from, rather than enhancing the experience of a user or an observer. According, a need existed for a flying toy having non-rotating portions affixed to a rotating disc that serve an aesthetic purpose and do not negatively affect the flight characteristics of the flying toy itself.

BRIEF SUMMARY OF THE INVENTION

The proposed invention presents an improvement over the prior art by providing a flying toy that includes non-rotating portions and improved flight characteristics.

The following summary is not an extensive overview and is not intended to identify key or critical elements of the apparatuses, methods, systems, processes, and the like, or to delineate the scope of such elements. This Summary provides a conceptual introduction in a simplified form as a prelude to the more-detailed description that follows.

Generally described, a first general concept is a flying toy apparatus, the flying toy apparatus when flying along a generally horizontal flight path comprising: A) a rotating disc portion having including a substantially circular central body portion having a top surface, a bottom surface, and a substantially circular outer periphery, and also including a substantially annular outside rim depending downwardly from the outer periphery and terminating at a substantially circular lower free edge, the rotating disc portion having a substantially vertical central rotational axis, the disc defining a lower cavity defined as underneath the rotating disc portion and above a substantially horizontal plane being substantially perpendicular to the central rotational axis and including the substantially circular lower free edge and, the rotating disc portion configured to rotate about the central rotational axis while flying along the generally horizontal flight path such that the rotational axis moves generally along the flight path while remaining generally perpendicular to the flight path; B) a gliding body portion comprising at least one underside aileron, the underside aileron including a downwardly directed aileron fin portion; and C) a rotating connection portion, the rotating connection portion rotatably connecting the rotating disc portion relative to the gliding body portion substantially about the vertical rotational axis, such that at least a portion of the downwardly directed aileron fin portion is within the cavity and defines a generally forwardly-facing surface which is inclined relative to horizontal, and remains forwardly-facing notwithstanding the rotation of the disc portion.

A variation or addition to the above first concept is wherein the aileron is configured to be trailing the connection portion when the flying toy apparatus is in at least a part of its flight.

Another variation or addition to the above first concept is wherein the aileron can still pivot slightly relative to flight path due to the presence of the rotating connection portion.

Another variation or addition to the above first concept is wherein the forwardly-facing surface of the aileron fin portion is substantially planar.

Another variation or addition to the above first concept is wherein the substantially planar forwardly-facing surface of the aileron fin portion is positioned at an angle relative to the rotational axis of the disc portion.

Another variation or addition to the above first concept is wherein the substantially planar forwardly-facing surface of the aileron fin portion is positioned substantially parallel relative to the rotational axis of the disc portion.

Another variation or addition to the above first concept is wherein the aileron is composed of a substantially planar subsection which is at an obtuse angle relative to the flight path of the apparatus.

Another variation or addition to the above first concept is wherein the aileron is composed of a substantially planar subsection which is at a right angle relative to the flight path of the apparatus.

Another variation or addition to the above first concept is wherein the aileron includes an arcuate portion which is directed towards said connecting portion.

Another variation or addition to the above first concept is wherein the arcuate portion of the aileron includes a concave side which is directed towards the connecting portion.

Another variation or addition to the above first concept is wherein the arcuate portion of the aileron is proximate the downwardly depending annular outside rim of the rotating disc and tends to follow the contour of the rim.

Another variation or addition to the above first concept is wherein the aileron is configured to be trailing the connection portion when the flying toy apparatus is in flight.

Another variation or addition to the above first concept is wherein the at least one aileron is a first aileron, and further comprising a second aileron adjacent the first aileron.

Another variation or addition to the above first concept is wherein the gliding base also includes a fuselage.

Another variation or addition to the above first concept is wherein the connecting portion includes a shaft which passes through a hole in both the disc portion and the gliding body portion and provides a connecting feature such that the disc portion and the gliding body portion can rotate relative to each other substantially about the longitudinal axis of the shaft.

Another variation or addition to the above first concept is wherein the connecting portion further comprises roller bearings.

Another variation or addition to the above first concept is wherein the connecting portion further comprises roller bearings having race diameters which are greater than the minimum spacing between the rotating disc portion and the gliding body portion.

Generally described, a second general concept is a method of operating a flying toy apparatus, the flying toy apparatus when flying along a generally horizontal flight path comprising the steps of: A) providing a flying toy apparatus itself comprising: 1) a rotating disc portion having including a substantially circular central body portion having a top surface, a bottom surface, and a substantially circular outer periphery, and also including a substantially annular outside rim depending downwardly from the outer periphery and terminating at a substantially circular lower free edge, the disc portion having a substantially vertical central rotational axis, the disc defining a lower cavity defined as underneath the disc portion and above a substantially horizontal plane including the substantially circular lower free edge and being substantially perpendicular to the central rotational axis, the disc portion configured to rotate about the central rotational axis while flying along the generally horizontal flight path such that the rotational axis moves generally along the flight path while remaining generally perpendicular to the flight path; 2) a gliding body portion comprising at least one aileron, the aileron including a downwardly directed aileron fin portion; and 3) a rotating connection portion, the rotating connection portion rotatably connecting the disc portion relative to the gliding body portion substantially about the vertical rotational axis, such that at least a portion of the downwardly directed aileron fin portion is within the cavity and defines a generally forwardly-facing surface which is inclined relative to horizontal, and remains forwardly-facing notwithstanding the rotation of the disc portion; B) launching the flying toy apparatus into flight, such that the disc portion rotates about its while the rotational axis moves generally along the flight path while the rotational axis remains generally perpendicular to the flight path, and such that the body portion, including the aileron, does not rotated but provides a gliding action.

A variation or addition to the above second concept is wherein the aileron trails the connection portion while the flying toy apparatus is in flight.

Another variation or addition to the above second concept is wherein the aileron trails the connection portion while the flying toy apparatus is in flight, but is still capable of variations in orientation relative to the flight path.

Another variation or addition to the above second concept is wherein the aileron trails the connection portion while the flying toy apparatus is in flight, but is still capable of a slight angular "cant" relative to the flight path, the direction of the cant depending on the direction of rotation of the disc.

Another variation or addition to the above second concept is wherein the aileron trails the connection portion while the flying toy apparatus is in flight due to a windsock effect.

Generally described, a third general concept is a flying toy apparatus, the flying toy apparatus when flying along a generally horizontal flight path comprising: A) a rotating disc portion having including a substantially circular central body portion having a top surface, a bottom surface, and a substantially circular outer periphery, and also including a substantially annular outside rim depending downwardly from the outer periphery and terminating at a substantially circular lower free edge, the disc portion having a substantially vertical central rotational axis, the disc defining a lower cavity defined as underneath the disc portion and above a substantially horizontal plane including the substantially circular lower free edge and being substantially perpendicular to the central rotational axis, the disc portion configured to rotate about the central rotational axis while flying along the generally horizontal flight path such that the rotational axis moves generally along the flight path while remaining generally perpendicular to the flight path; B) a gliding body portion comprising at least one aileron, the aileron including a downwardly directed aileron fin portion; and C) a rotating connection portion, the rotating connection portion rotatably connecting the disc portion relative to the body portion substantially about the vertical rotational axis, such that at least a portion of the downwardly directed aileron fin portion is within the cavity and defines a generally forwardly-facing surface which is inclined relative to horizontal, and remains forwardly-facing notwithstanding the rotation of the disc portion, the rotating connection portion also including: 1) an upper bearing assembly positioned above the central body portion of the disc portion, the upper bearing assembly itself including an upper race element, a lower race element configured to be attached relative to the central body portion of the disc portion, and intermediate rolling bearing elements between the upper and lower race elements; 2) a lower bearing assembly. positioned below the central body portion of the disc portion, the lower bearing assembly itself including an upper race element configured to be attached relative to the central body portion of the disc portion, a lower race element configured to be attached relative to the gliding body portion, and intermediate rolling bearing elements between the upper and lower race elements; and 3) a connecting rod element configured to connect the following three elements together: a) the upper race element of the upper bearing; b) the lower race element of the lower bearing; and c) the gliding body portion, such that the rotating disc portion can rotated thereto.

A variation or addition to the above third concept further comprises a gliding fuselage attached to the lower race element of the lower bearing.

Another variation or addition to the above third concept is wherein the gliding fuselage is interchangeable with other gliding fuselages to allow for many different customizable appearances.

Another variation or addition to the above third concept further comprises a gliding decorative top member attached to the upper race element of the upper bearing.

Another variation or addition to the above third concept is wherein the gliding fuselage is interchangeable with other gliding fuselages to allow for many different customizable appearances.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

Figure 1:
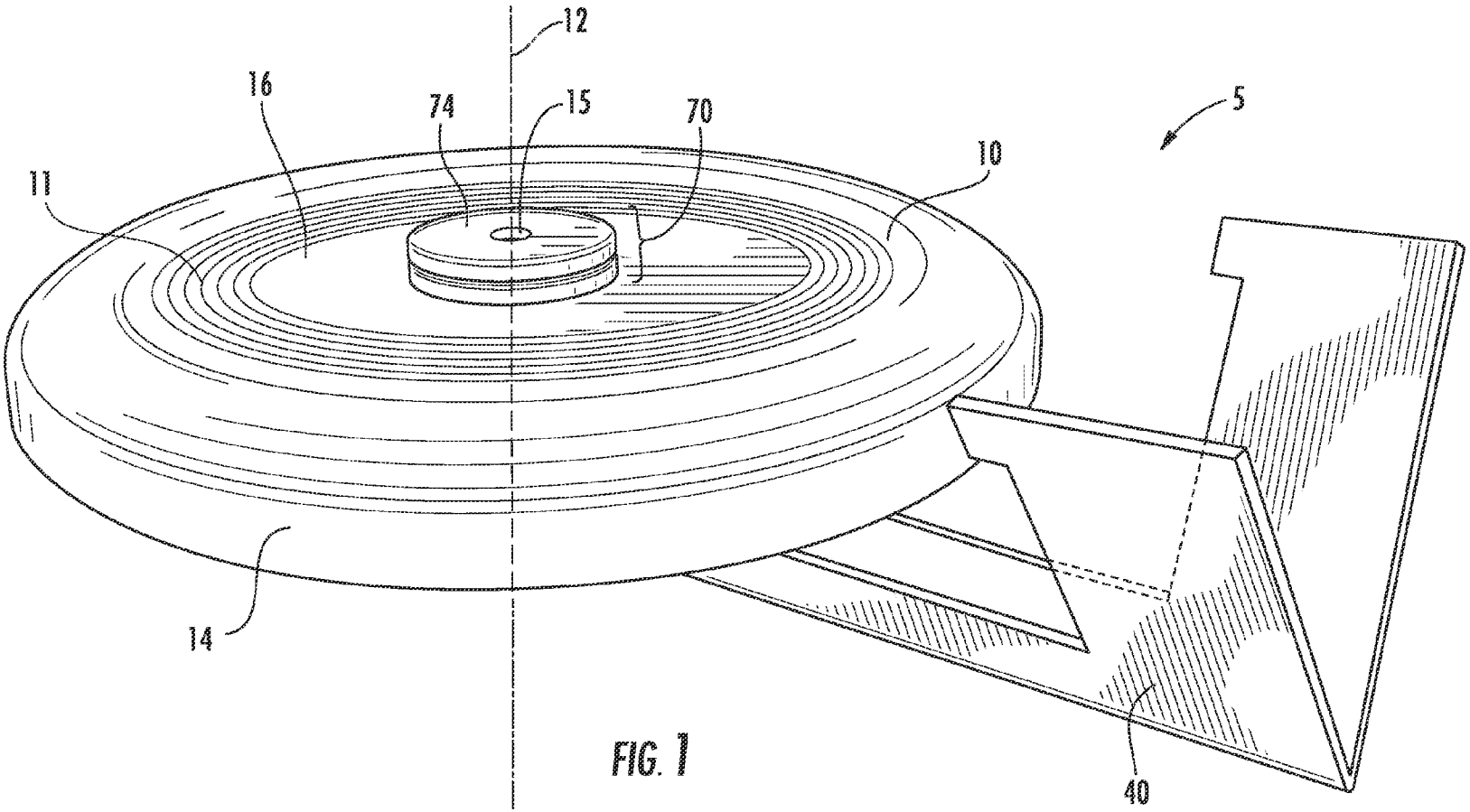

Having thus described the invention in general terms, reference will now be made to the accompanying drawings, which are not necessarily drawn to scale, and wherein:

FIG. 1 is an upper pictorial view of the apparatus 5 from a slightly elevated point of view, such that the top of the disc portion 10 is viewable. For discussion purposes only, the apparatus 5 is presumed for discussion herein to be oriented such that the axis 12 is substantially vertical. The apparatus 5 includes a disc portion 10, a gliding body portion 20, and a rotating connection portion 70.

Figure 2:
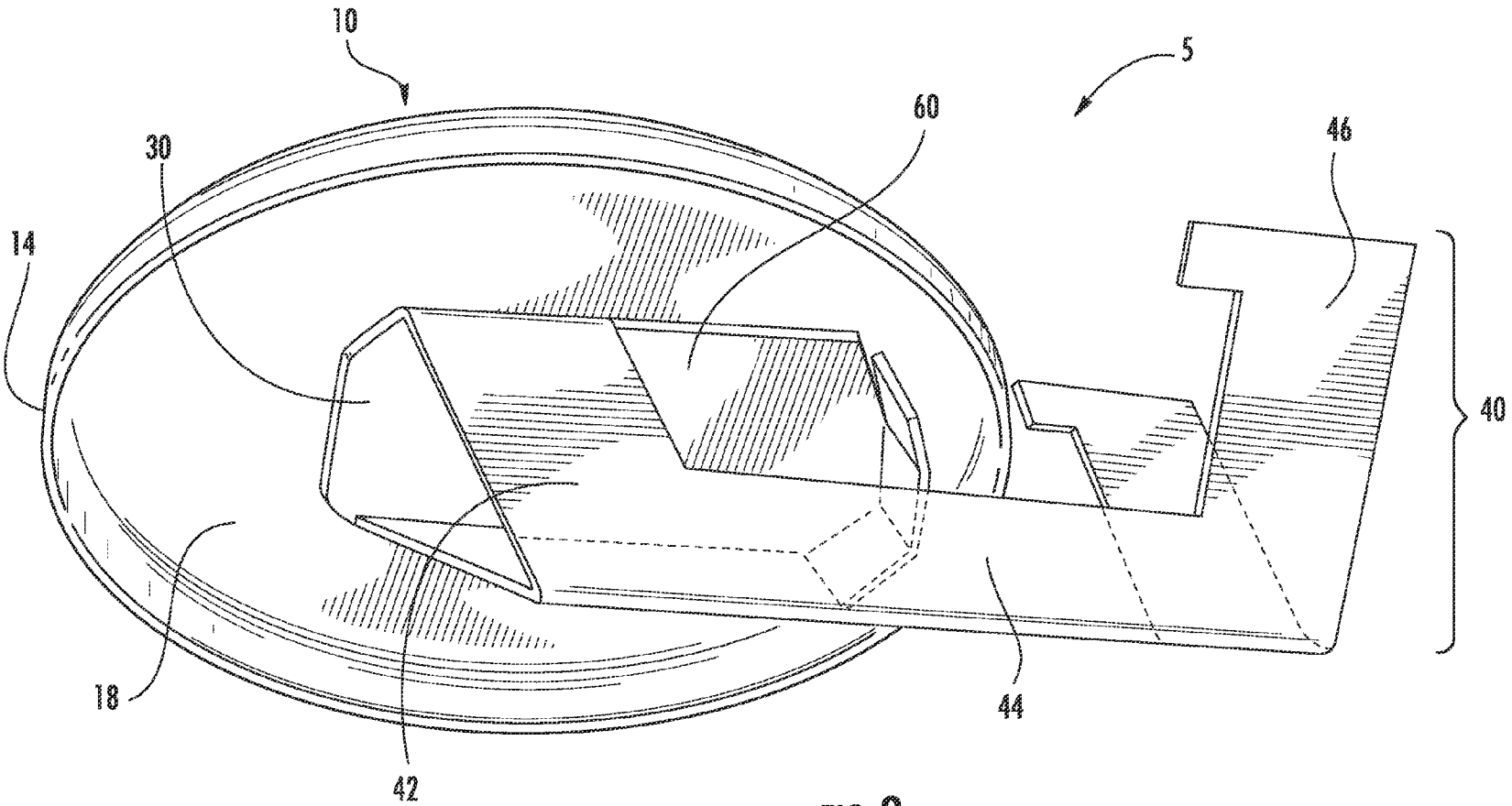

FIG. 2 is a lower pictorial view of the apparatus 5 from a slightly lowered point of view, such that the underneath of the disc portion 10 is viewable.

Figure 3:
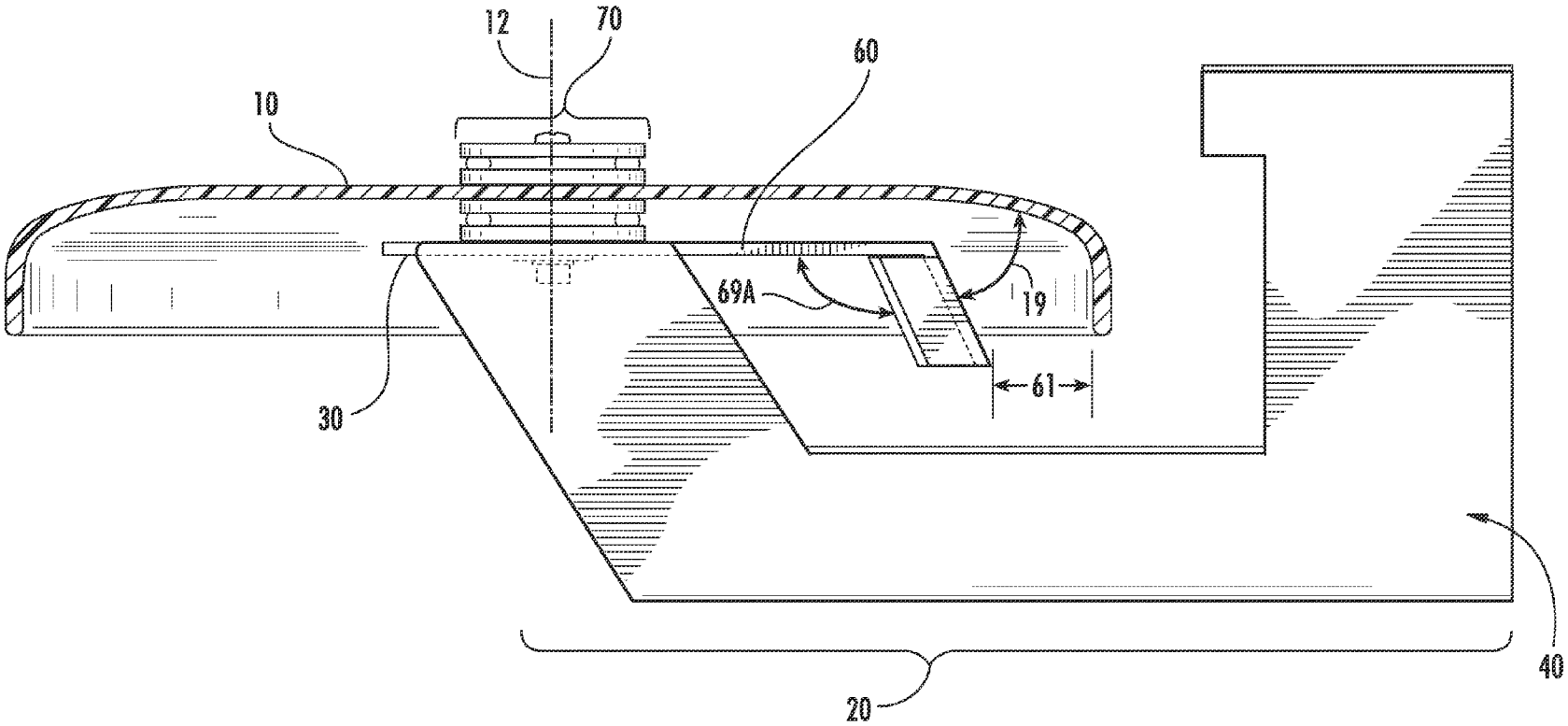

FIG. 3 is a side elevational view of the apparatus 5, such that the gliding body portion 20 (which includes the main body panel 30, the fuselage subassembly 40, and the underside aileron subassembly 60) is viewable. The disc portion 10 is shown in cross section while the other elements are not.

Figure 4:
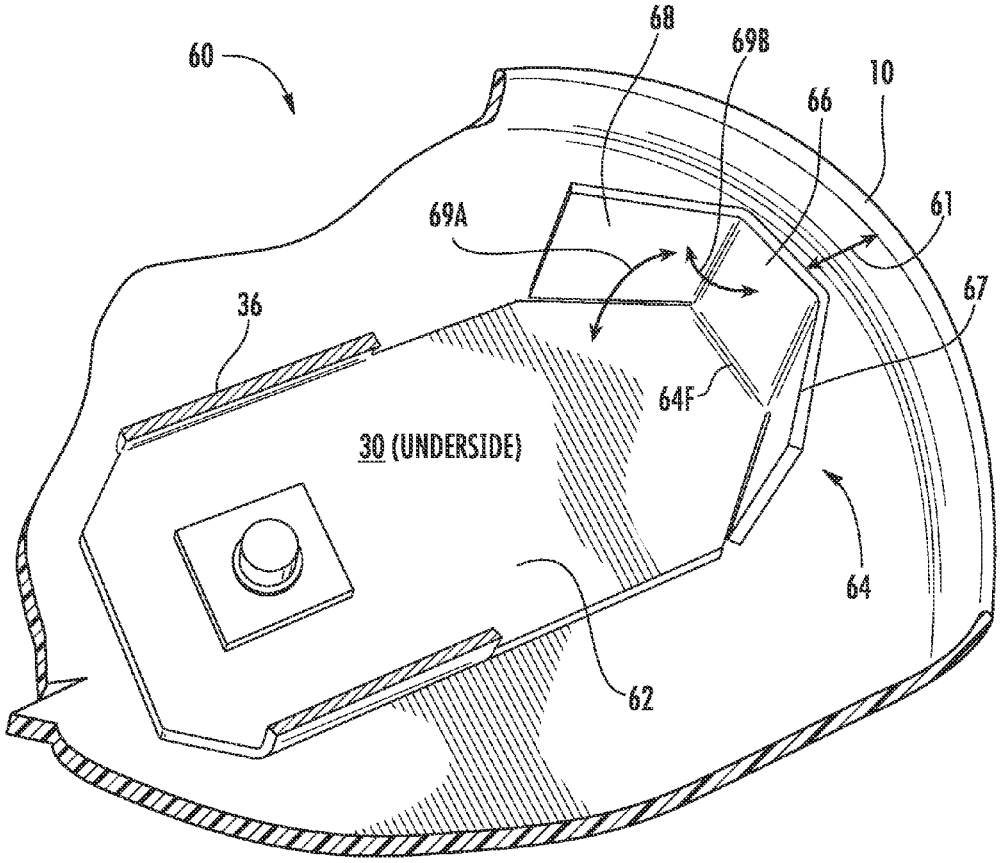

FIG. 4 is an upper pictorial isolated view of the aileron subassembly 60 as it would look if the apparatus 5 is inverted from its conventional orientation, placed atop a horizontal supporting surface (not shown), and the fuselage subassembly 40 cut away for illustrative purposes (the cross hatching shows the cutaway location). Note the cut away portion of the disc 10. In this view the underneath (a.k.a. underside) of the rearwardly extending portion 62 and the aileron portion 64 are viewable.

Figure 5:
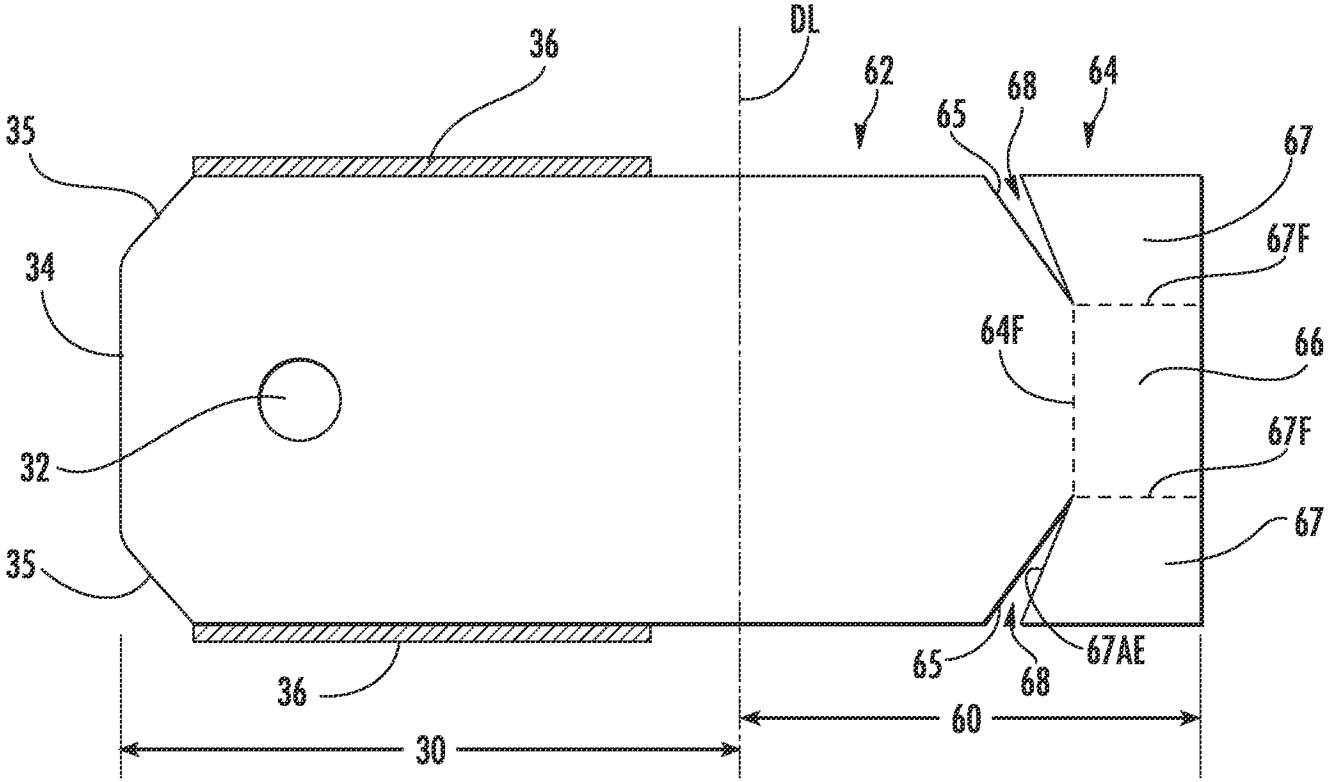

FIG. 5 is a bottom plan view of the main body panel 30 and the aileron subassembly 60, with the aileron portion 64 folded out into a pre-folded, "blank" configuration and the fuselage subassembly 40 cut away for illustrative purposes (the cross hatching shows the cutaway location).

Figure 6:
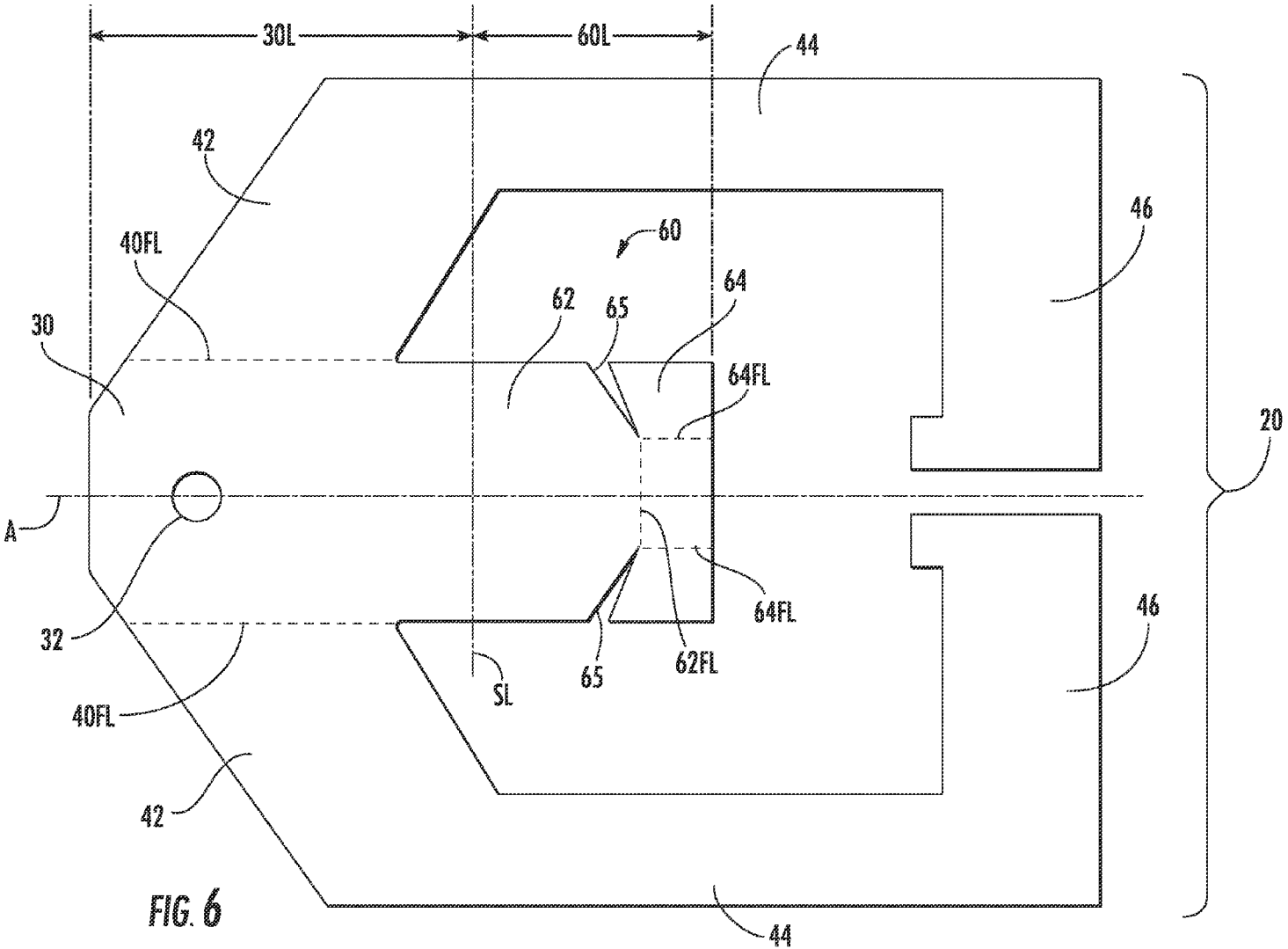

FIG. 6 is a top (or bottom) elevational view of the gliding body portion 20 in "blank" unfolded configuration. As may be understood the gliding body portion 20, includes the main body panel 30, the fuselage subassembly 40, and the aileron subassembly 60. The dotted lines illustrate the length of the main body panel 30 as "30L", and the length of the aileron subassembly 60 as "60L".

Figure 7:
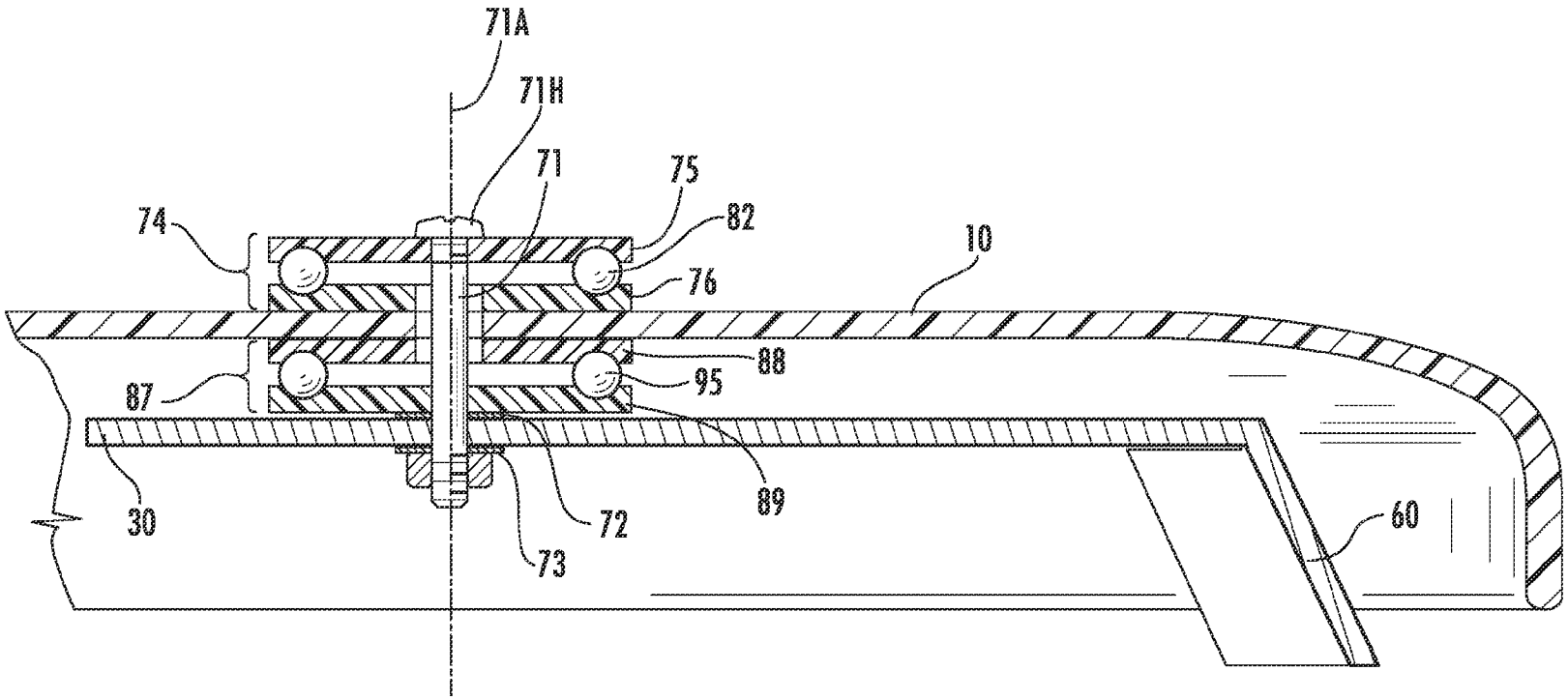

FIG. 7 is a detailed cross sectional view of the rotating connection portion 70 of the apparatus 5 shown in FIG. 1, as well as a portion of the disc portion 10 (shown in cross section) and the gliding body portion 20 (also shown in cross section).

Figure 8:
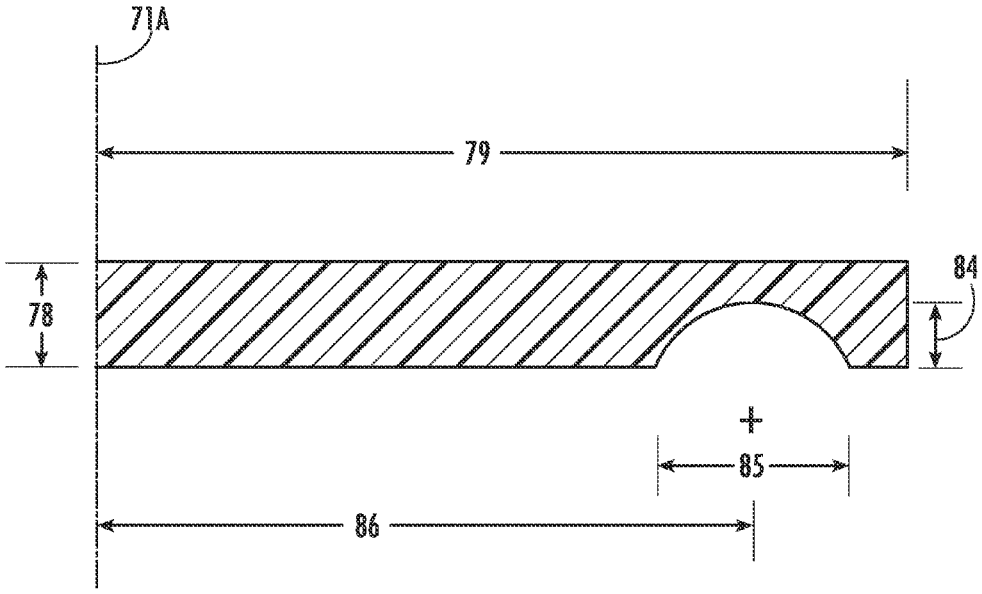

FIG. 8 is a cross sectional view of the right half of the symmetrical upper bearing subassembly 74 of the rotating connection portion 70.

Figure 9:
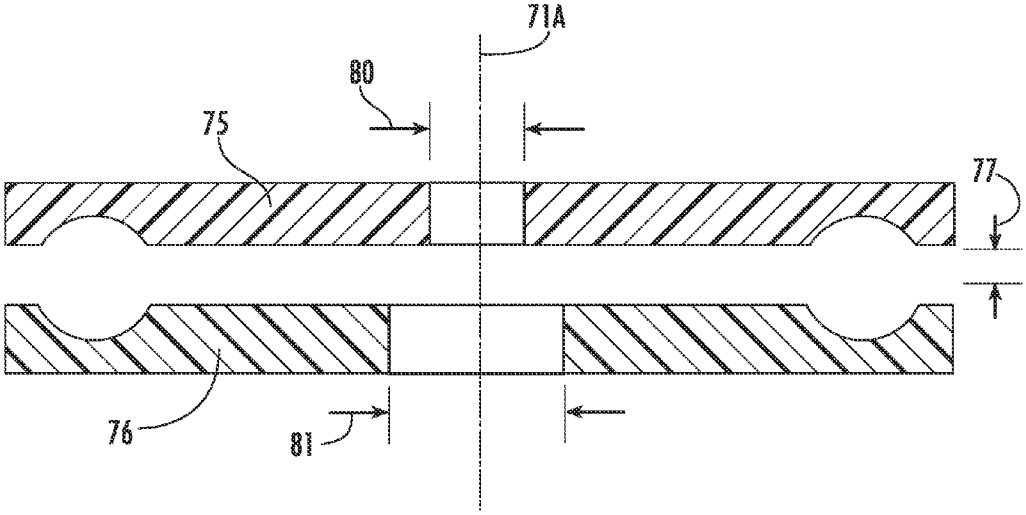

FIG. 9 is a cross sectional view of the symmetrical upper bearing subassembly 74 and the symmetrical lower bearing subassembly 87 of the rotating connection portion 70.

Figure 10A:
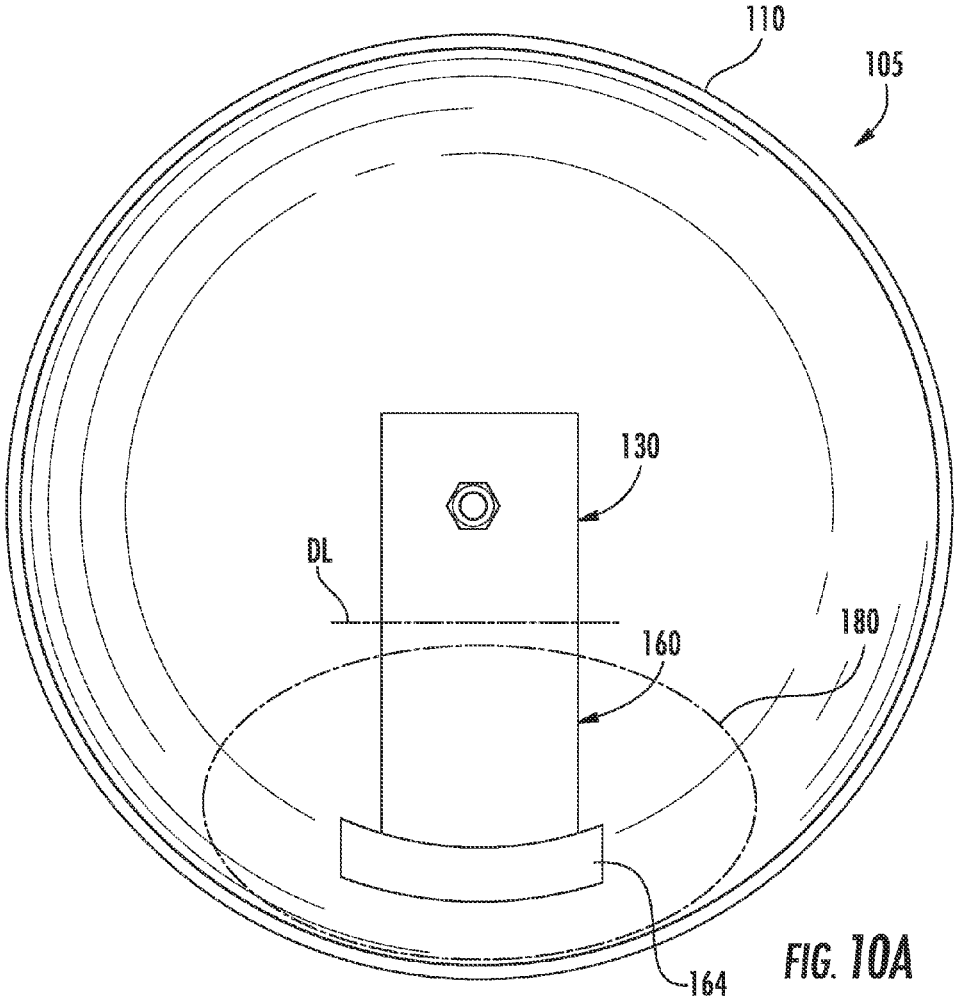

FIG. 10A is a bottom view of an apparatus 105, which only includes an aileron and does not include a fuselage. In this figure the gliding body portion 120, including the main body panel 130 and the aileron subassembly 160 (having a downwardly-directed arcuate aileron fin 164, is viewable. A positive pressure area 180 is shown outlined in a dotted line.

Figure 10B:
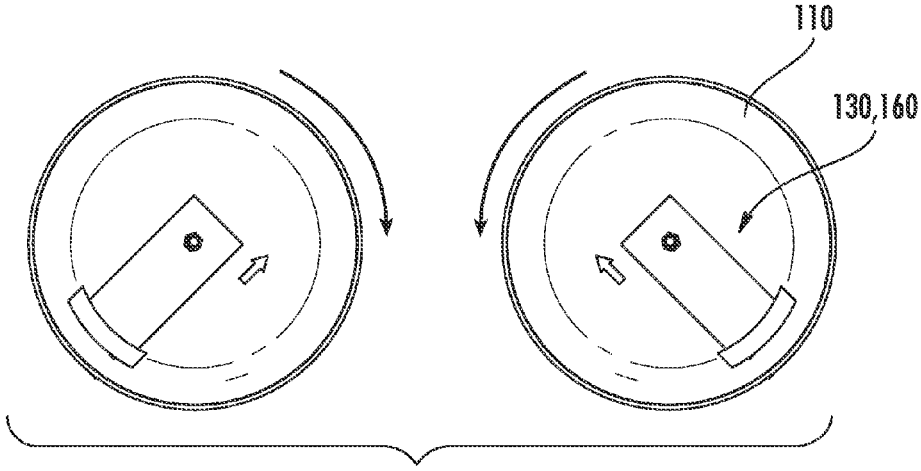

FIG. 10B illustrates the manner in which the main body panel 130 and the aileron subassembly 160 tend to "cant" (be at an angle relative to) the throwing axis to one side or the other, during and upon the throw of the device 5. It is believed that this "cant" (slightly more clockwise in the left side drawing and slightly more counterclockwise in the right side drawing) is caused by a combination of friction (very small effect) in the rotating connection portion, air flow underneath the flying disk (large effect), and the handedness of the thrower (i.e., spin direction of the disc portion 110).

Figure 11:
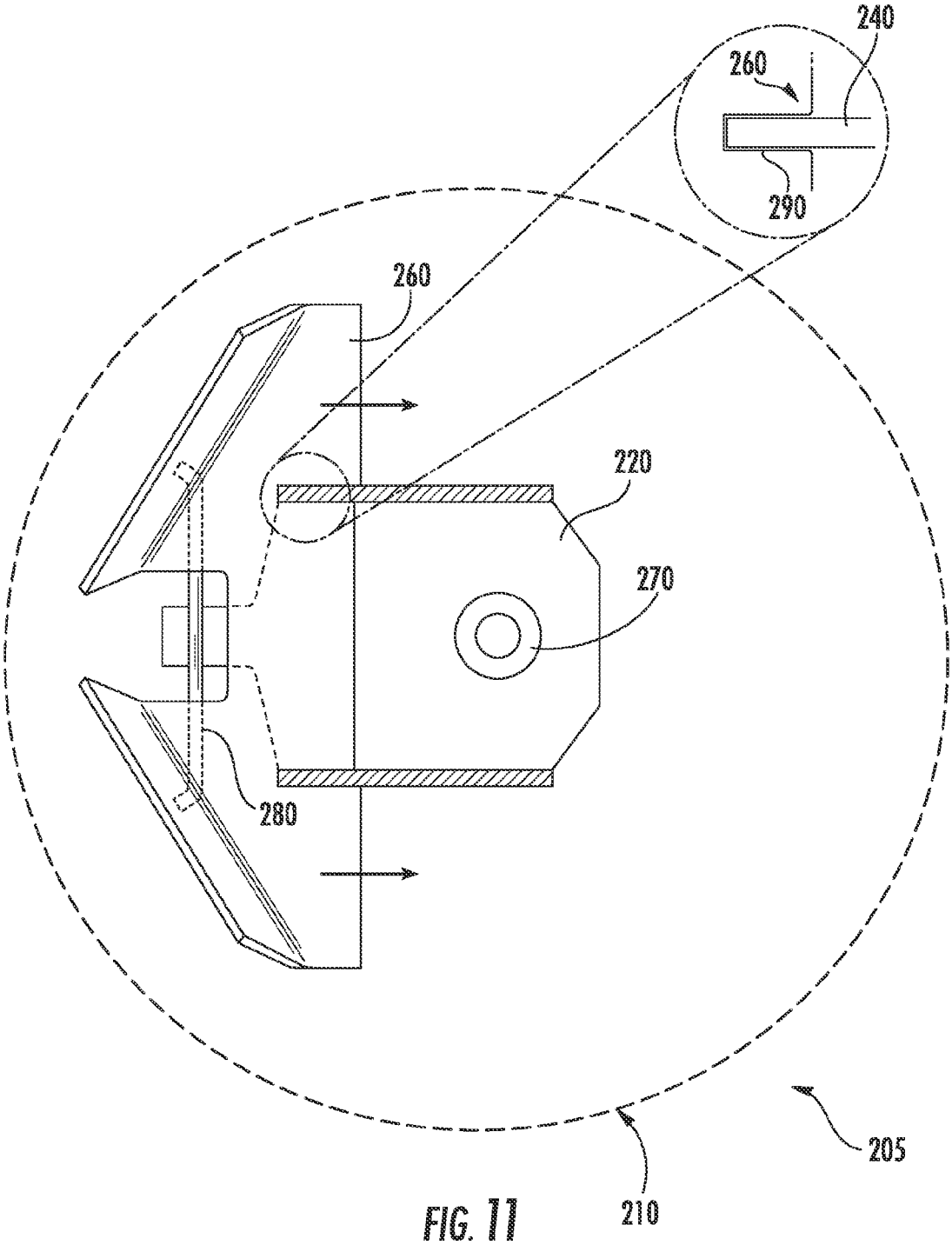

FIG. 11 is a bottom view of an additional embodiment apparatus 205, which includes an aileron subassembly 260 which is separate from the main body panel 230. The fuselage subassembly 240 is cut away for illustrative purposes. A pin 280 is also shown, which is for maintaining the angle of the aileron subassembly 260 relative to the main body panel 230 and the disc portion 210. The smaller isolated drawing shows the manner in which slots 290 in the aileron subassembly 260 fit around the downwardly-extending walls of the fuselage subassembly.

Figure 12:
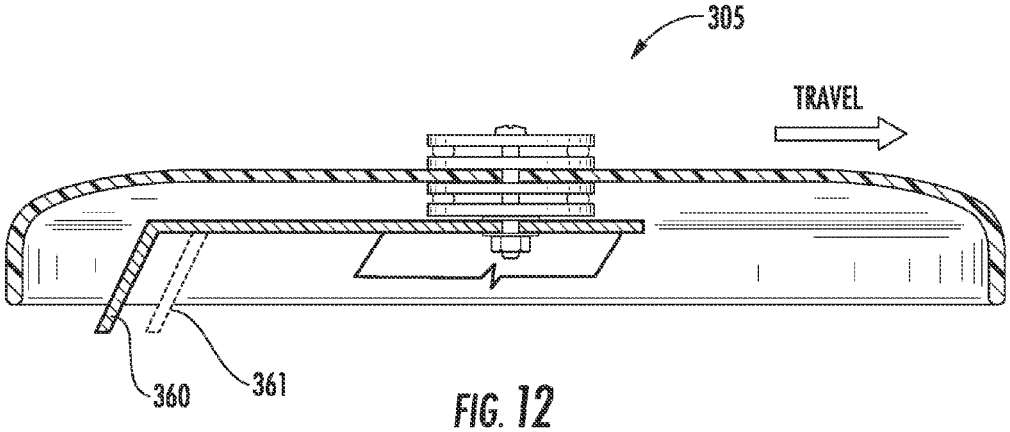

FIG. 12 is a side illustrative view of an additional embodiment apparatus 305, illustrating the use of an exemplary aileron subassembly 360, with an additional aileron element 361 which allows for two (or more) ailerons to be used concurrently. It should be understood that this member could be used in combination with other elements such as shown in the apparatus 5, 105, 205, or other embodiments.

Figure 13:
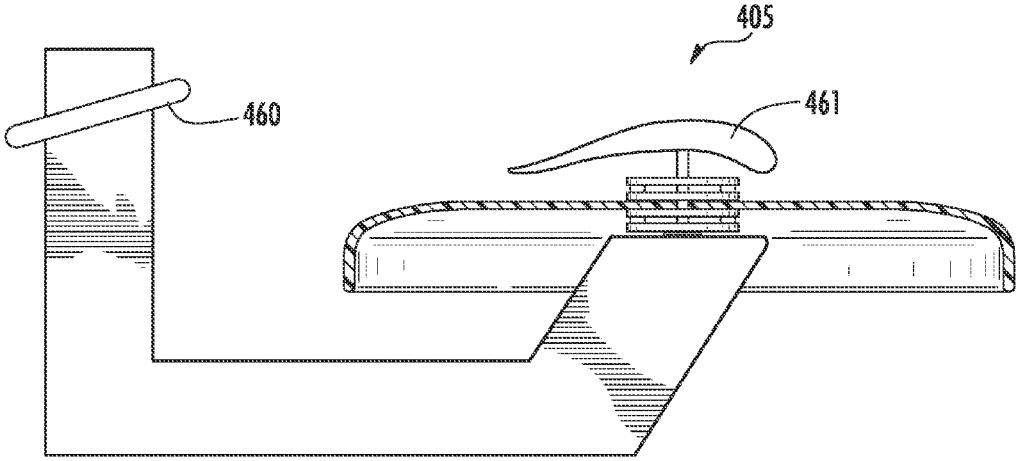

FIG. 13 is a side elevational illustrative view of an additional embodiment apparatus 405 illustrating the use of two additional ailerons 460 and, which could be used together or apart. The rear fuselage mounted aileron 460 is mounted to the rear of the fuselage, and can be configured to provide tail lift as needed. The other alternate aileron 461, shaped much like an air foil, could be attached to the top of the assembly, such that it is part of the "gliding" portion of the device. This exemplary wing could have a consistent cross section such as shown in the figure, and have a width as desired. It should be understood that this member could be used in combination with other elements such as shown in the apparatus 5, 105, 205, or other embodiments.

Figure 14:
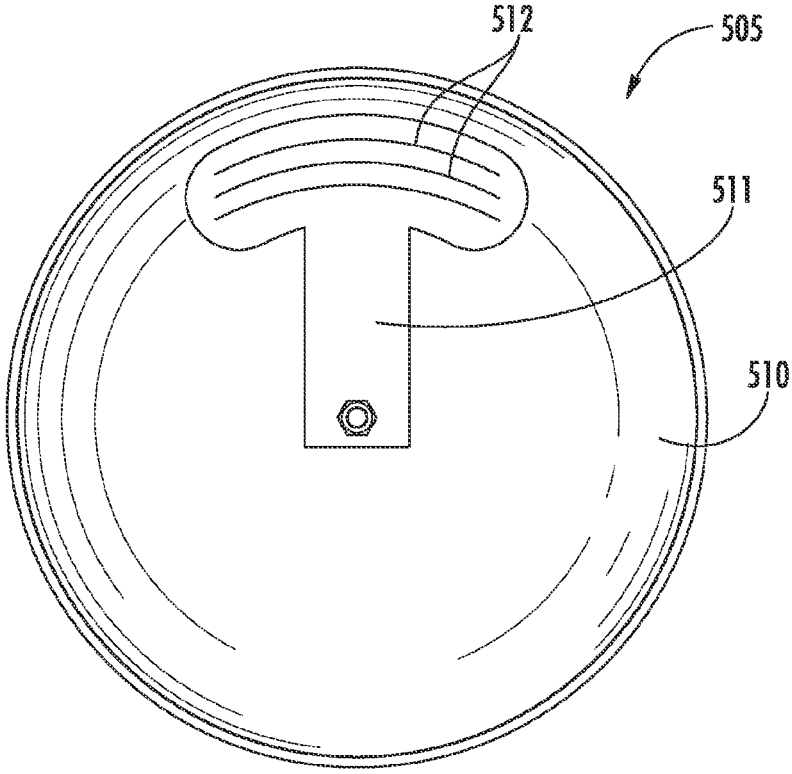

FIG. 14 is a top elevational view of an additional embodiment apparatus 505, which could include a device such as 5 described above, but also includes the use of a forward-mounted "turbulation" member 511, which is essentially "T" shaped, and has multiple upwardly protruding ridges 512 molded in its surface to create turbulence and to decrease air pressure on the top. This member is configured to be mounted to the upper race of an upper bearing member in a dual bearing configuration such as shown in FIG. 7, such that the "turbulation" member 511 is part of the "gliding" portion of the device, and is thus kept in the front due to the orientation of the fuselage, which is not shown. If needed, additional tail elements could be added to assure orientation of the fuselage (and the turbulation member).

Figure 15:
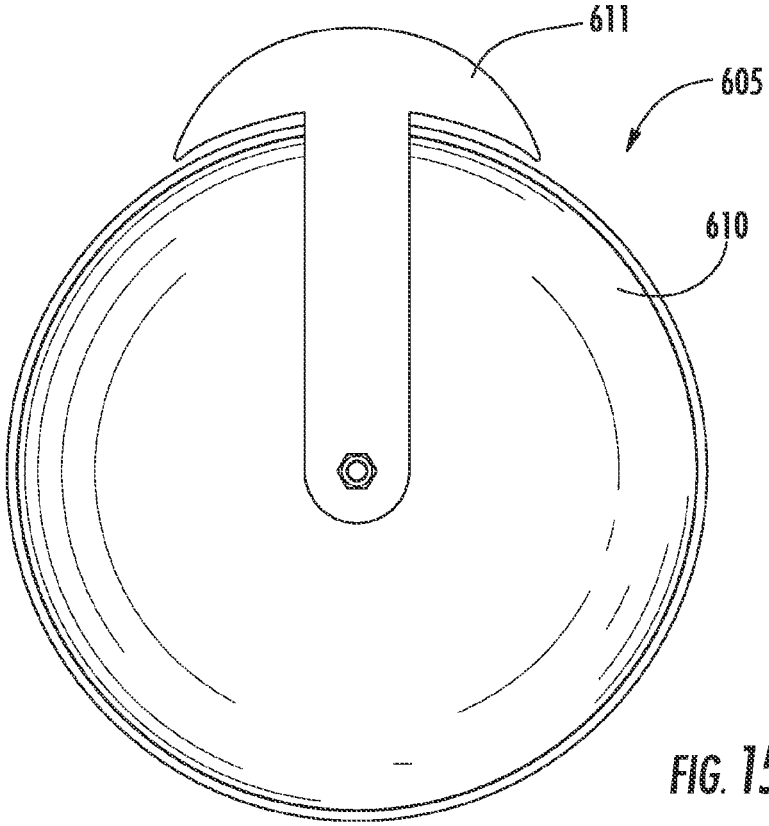

FIG. 15 is a top elevational view of an additional embodiment apparatus 605, which could include a device such as 5 described above, but also includes the use of a forward-mounted "canard" member 611, which is configured to be mounted to the upper race of an upper bearing member in a dual bearing configuration such as shown in FIG. 7, such that the "canard" member 611 is part of the "gliding" portion of the device, and is thus kept in the front due to the orientation of the fuselage, which is not shown. If needed, additional tail elements could be added to assure orientation of the fuselage (and the turbulation member). The "canard" member 611 is configured to be pre-shaped (or bendable as needed), in order to compensate for weight of the device as desired. For example, the leading edge of the "canard" member could be bent downwardly, to cause the canard wing to move downwardly relative to the incoming wind, causing the tail end of the device to rise.

Figure 16:
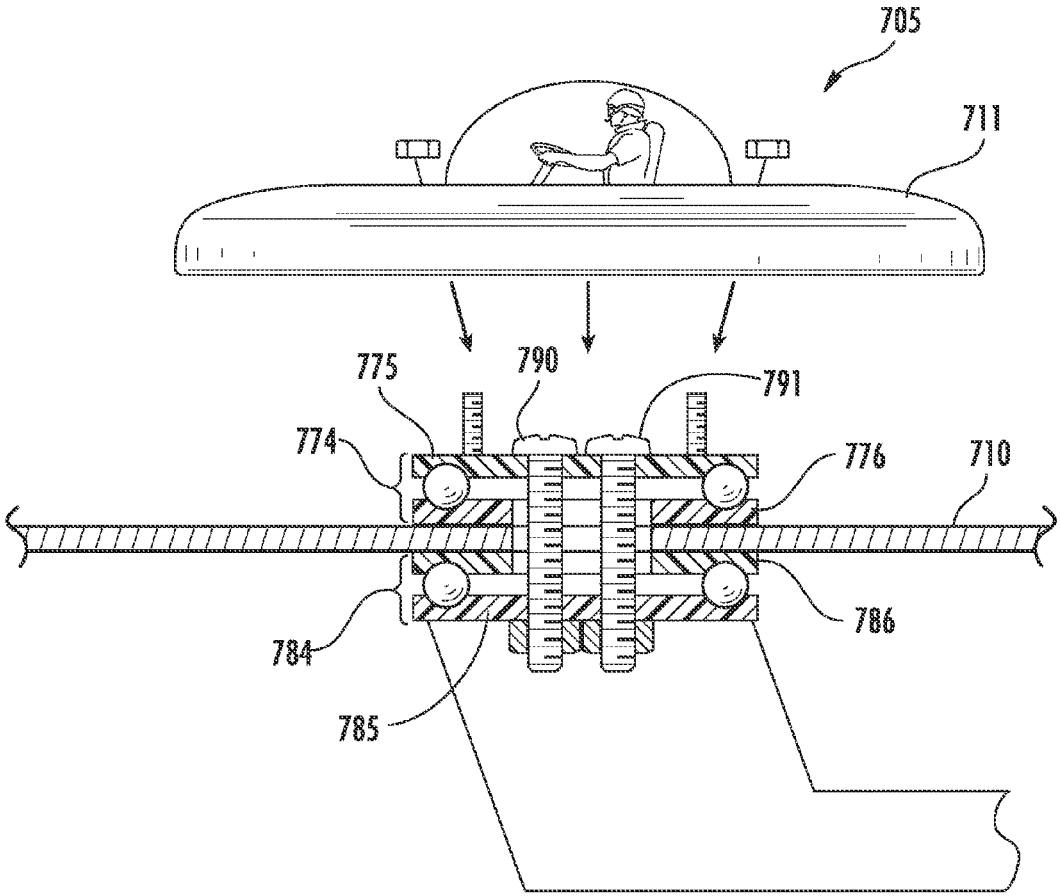

FIG. 16 is an illustrated side view showing a bearing design, which includes two fasteners 790, 791, in order to accommodate a top mounted decorative member 711, which can be placed on the top race element 775 of the top bearing subassembly 774. The fuselage subassembly 740 and the top mounted decorative member 711 remain aligned because the fasteners create a single unit, which tends to "glide" as compared to the rotating race elements 776, 786 attached to the disc portion 710.

Figure 17:
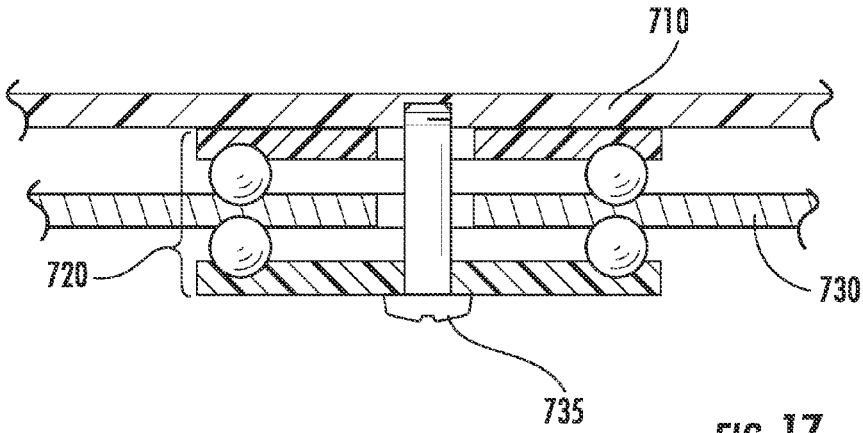

FIG. 17 is an illustrative side cross sectional view of an alternate bearing design, in which a bearing 720, albeit a double-race bearing, is only on one side of the disc, in this case the underside. This figure shows the disc portion 710, the bearing 720 positioned underneath the disc, and the base 730. A fastener 735 is also shown connecting elements 710, 720. In this configuration the fastener 735 rotates with the flying disc 710.

Figure 18A:
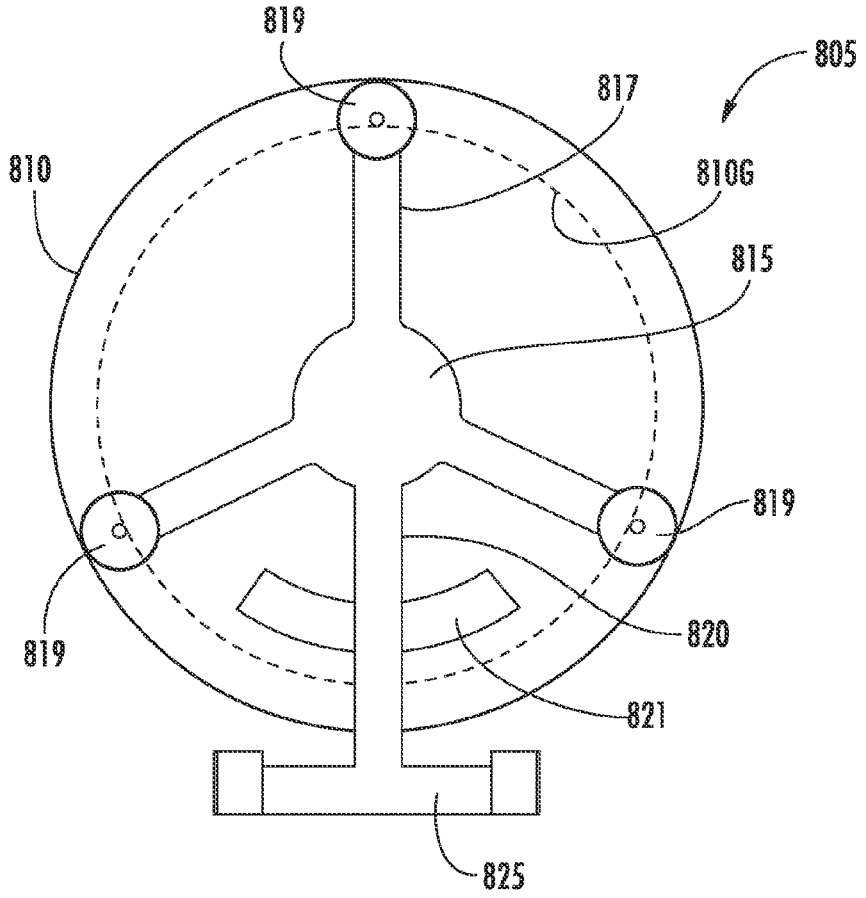

FIG. 18A is a bottom illustrative view of an additional embodiment apparatus 805, which could include a disk 810 rotatably mounted relative to a base member 815, which includes a plurality of rollers 819, which roll within slots provided in the periphery of the flying disc. The plurality of rollers 819 rotate while having their peripheral edges captured and guided within a groove 810G cut or molded around the inside rim of the flying disc. The rollers 819 are mounted to the outward end of radial spokes 817 which extend outwardly from the central portion base member 815. A tail member 820 has tail fins 825 and supports an aileron 821 attached to the tail member, which can fit underneath the flying disc in a manner similar to elements 60, 160, or 260 noted above.

Figure 18B:
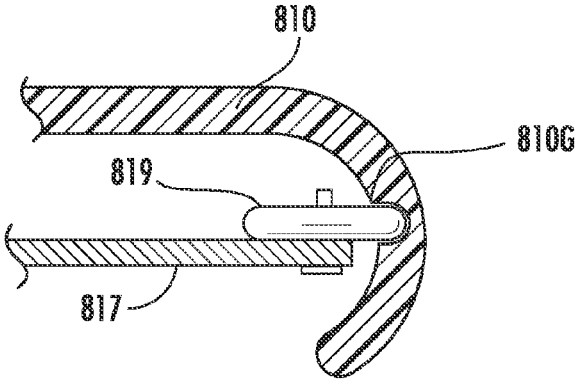

FIG. 18B is a detailed view of a portion of the additional embodiment apparatus 805 described above. It shows the interior annular groove 810G which accepts the edges of the rollers 819.

Figure 19A:
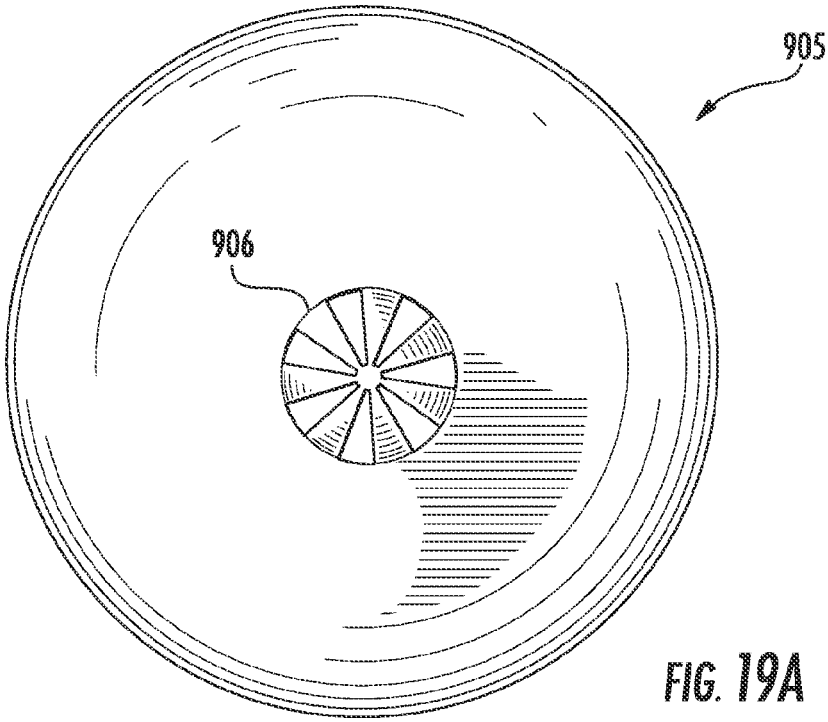

FIG. 19A is a top illustrative view of an additional embodiment apparatus 905, which could include a fan 906 in a disc portion 910, which when placed in the center, provides further lift by driving air from above the top of the disc portion 910 through and to the underneath of the disc, thus providing increased pressure underneath the disc.

Figure 19B:
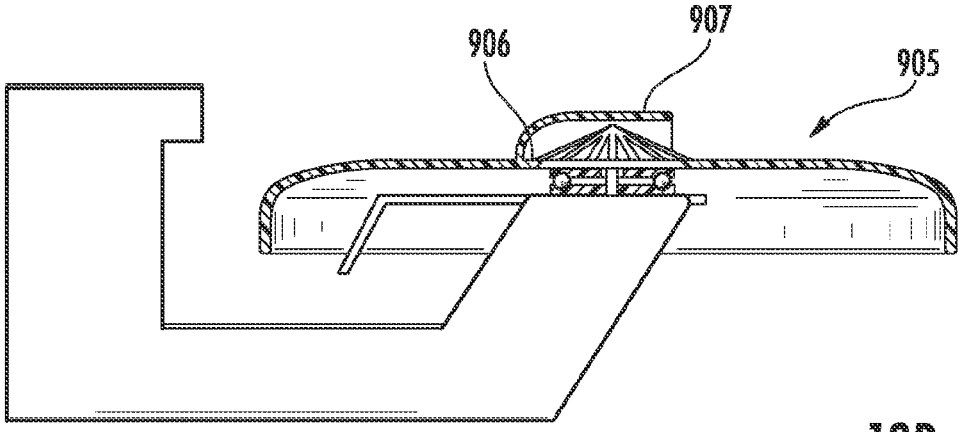

FIG. 19B shows the side illustrated view of the additional embodiment apparatus 905 shown in FIG. 19A. A scoop 907, which is in the "glider" portion of the device, tends to direct air coming in from the front of the device, down passed the rotating fan, which rotates with the flying disc.

DETAILED DISCUSSION

Various embodiments of the present invention now will be described more fully hereinafter with reference to the accompanying drawings, in which some, but not all embodiments of the invention are shown in the figures. Indeed, the present invention may be embodied in many different forms and should not be construed as limited to the embodiments set forth herein; rather, these embodiments are provided so that this disclosure will satisfy applicable legal requirements. Like numbers refer to like elements throughout.

I. General

The invention generally is directed towards flying devices, in particular flying toys or other recreational items that are designed to be thrown through the air by a user participating in any one of a variety of throwing (i.e. "catch") games. In particular, the concept is directed toward a flying disc having rotatably attached non-rotating (a.k.a. "gliding") portions that are attached to the disc and provide an optical illusion, wherein the user (and, similarly, an observer) does not notice the spinning of the flying disc, but instead sees a flying craft that appears to have no propulsion, yet flies. While the non-rotating portions alter the airflow associated with a typical flying disc, they do not negatively affect the flight characteristics of the disc itself. Indeed, in certain embodiments, the non-rotating portions (e.g., ailerons) have been observed to improve the flight characteristics of typical flying discs. The non-rotating (a.k.a. "gliding") portions also provide surfaces upon which to place advertising that remains legible during flight. In this manner, the non-rotating portions of the flying device serve both a functional and an aesthetic purpose, thereby providing an improved enjoyment and functionality for users of the device.

II. Details

Elements List

The elements of the invention include the following:

5. First Embodiment Apparatus (FIG. 1)
10. Disc portion
11. Ridge(s)
12. Central axis of rotation
14. Rim
15. Opening
16. Convex top surface
18. Concave bottom surface
19. Disc angle
20. Gliding Body Portion
30 Main body panel
  32 Opening
  34 Front edge
  35 Corner
  36 Side edge
  38 Trailing edge
40 Fuselage subassembly
  42 Downwardly extending portion
  44 Rearwardly extending portion
  46 Upwardly extending fin portion
60 Underside aileron subassy
  61 distance from rim
  62 Aileron body portion
  64 Aileron fin portion
    65 Angled edges
    66 central portion
    67 side portions
    67F folding

67AE angles edge
68 notches
69A Aileron angle
69B Side portion angle
70. Rotating connection portion
71 Central Shaft (with head 71H and axis 71A)
72 Inner nut
73 Outer nut
74 Upper bearing subassembly
75 Upper race element
76 Lower race element
77 Upper/Lower Race spacing
78 Race height
79 Race element radius
80 Upper race central opening
81 Lower race central opening
82 Ball Bearings
83 Groove(s)
84 Groove Depth
85 Groove Width
86 Groove radius
87 Lower bearing subassembly
88 Upper race element
89 Lower race element
90 Upper/Lower Race spacing
91 Race height
92 Race element radius
93 Upper race central opening
94 Lower race central opening
95 Ball Bearings
96 Groove(s)
97 Groove Depth
98 Groove Width
99 Groove radius
105. Second Embodiment Apparatus (FIG. 10)
110 Disc Portion
120 Gliding Body Portion
130 Main body panel
160 Underside ileron subassembly
164 Aileron fin portion
170 Rotating connection portion
205 Third Embodiment Apparatus (FIG. 11)
210 Disc Portion
220 Gliding Body Portion
230 Main body panel
240 Fuselage subassembly
260 Underside aileron subassembly
270 Rotating connection portion
280 Pin
290 Slot(s)
305 Fourth Embodiment Apparatus (dual aileron—FIG. 12)
360 Underside aileron subassembly
361 Additional underside aileron
405 Fifth Embodiment Apparatus (Tail mounted and foil ailerons—FIG. 13)
460 Rear fuselage mounted aileron
461 Airfoil type aileron
505 Sixth Embodiment Apparatus (Front spoiler with ridges—FIG. 14)
510 Disc portion
511 forward-mounted "turbulation" member
512 multiple protruding ridges
605 Seventh Embodiment Apparatus (FIG. 15)
610 Disc Portion
611 Front leading canard member
705 Eighth Embodiment Apparatus (Top mounted shape/dual fasteners—FIGS. 16/17)
710 Disc Portion
711 Top mounted decorative member
720 alternative bearing
730 alternative base
735, 790, 791 fasteners
740 Fuselage subassembly
774 Top Bearing subassembly
775 Top Race element
776 Rotating Race element
784 Top Bearing subassembly
785 Bottom Race element
786 Rotating race element
805 Ninth Embodiment Apparatus (Radially mounted bearings—FIG. 18)
810 Disc portion (with Groove 810G)
815 Base member
817 Radial spokes
819 Plurality of rollers
820 Tail member
812 Aileron
825 Tail fins
905 Seventh Embodiment Apparatus (Fan plus scoop—FIG. 19)
906 Fan
907 Scoop
910 Disc portion Structure of First Embodiment Apparatus In various embodiments, as can be seen from FIGS. 1 and 2, the apparatus 5 includes a disc portion 10, a gliding body portion 20, and a rotating connection portion 70.

Generally described, the apparatus is assembled by positioning the disc portion relative to the gliding body portion as shown in FIG. 1, and completing the assembly of the rotating connection portion 70, which holds the two portions 10, 20, together.

Generally described, when the apparatus is thrown or otherwise launched in a general direction, the disc portion 10 is also given provided with spin or rotation about its central rotational axis (shown as 12 in FIG. 1), such that the gliding body portion 20 "glides", while the disc portion 10 rotates. The rotation connection portion has portions which glide, and portions which rotate, and provides a bearing connection between the two which preferably provides as little torsional drag between the two members 10, 20 as possible.

Disk Portion

According to various embodiments, as best understood from FIGS. 1 and 2, the disc portion 10 is generally circular in shape and includes a substantially convex top surface 16 and a substantially concave bottom surface 18. In certain embodiments, the disc portion 10 comprises a saucer shaped device such as that described in detail in U.S. Pat. Nos. 3,359,678 and 3,724,122, which are hereby incorporated by reference herein. The trademark "FRISBEE" as also been used in conjunction with some such flying discs.

In particular embodiments, the disc portion 10 includes a rim 14 about its periphery so that when viewed in elevation, the disc portion approximates an airfoil. In various embodiments, the disc portion 10 is typically projected into the air by grasping the disc portion by its rim 14 and throwing the disc portion outward by a wrist snapping motion. Consequently, during an airborne flight, the disc portion 10 rotates about a central axis of rotation 12 of the disc portion.

In various embodiments, as can be seen in FIG. 1, the substantially convex top surface 16 extends downwardly from a point of maximum elevation of the disc portion 10. In certain embodiments, the point of maximum elevation substantially aligns with the central axis of rotation 12. In a particular embodiment, the substantially convex top surface 16 extends radially outward from the central axis of rotation 12 and downward, until reaching the rim 14, disposed about the periphery of the disc portion 10. In certain embodiments, the rim 14 extends downwardly in an essentially perpendicular relation to the general plane of the substantially convex top surface 16.

As further shown in FIG. 1, according to various embodiments, the substantially convex top surface 16 includes a plurality of concentric ridges 11. The ridges 11, in certain embodiments, produce an air spoiling effect and a turbulent, closely adhering, boundary layer flow of air over the convex top surface 16 that results in an increased stability in the flight characteristics of the disc portion 10. Further characteristics and benefits of such ridges 11 are described in greater detail in U.S. Pat. No. 3,724,122, which is hereby incorporated by reference herein. In other embodiments, the substantially convex top surface 16 is substantially smooth (i.e., having no ridges 11). In certain of these embodiments, attachment of non-rotating members adjacent the substantially convex top surface 16 (as discussed in greater detail later) produce an air spoiling and turbulent effect similar to that of the ridges 11 and thus likewise improve the flight characteristics of the disc portion 10.

In various embodiments, the disc portion 10 includes a centrally disposed opening 15 at the top for mounting the rotating connection portion 70 substantially adjacent the disc portion 10. In certain embodiments, the centrally disposed opening 15 substantially aligns with the central axis of rotation 12, as best seen in FIG. 1. In particular embodiments, the opening 15 is substantially cylindrically shaped. In certain of those embodiments, the opening 15 has a diameter that is greater than 3/16 of an inch, which serves to prevent rotational drag and/or torque between a central shaft 71 (to be discussed in further detail later) placed through the opening 15 and the disc portion 10. In other of those embodiments, the opening 15 has a diameter of approximately ¼ of an inch. In certain embodiments, the opening 15 is any of a variety of shapes (i.e., square, rectangular, hexagonal, etc.). In certain of those embodiments, the opening 15 is greater than 3/16 of an inch when measured across the opening 15 in any direction. In other of those embodiments, the opening 15 is approximately ¼ of an inch in size.

For purposes of this description, the central axis of rotation 12 of the various components around the central shaft 71 (and thus the cylindrical-shaped opening 15) of the apparatus 5 will be assumed to be substantially "vertical", although this is only a relative term for purposes of discussion, under the presumption that the apparatus itself is in normally horizontal flight.

In the embodiments shown, the disc portion 10 does not require assembly as it is unitary.

In operation, the disc portion 10 is grasped by the hand of a user, and "thrown" much in the same way a flying disk is conventionally thrown when not including other elements attached thereto.

Gliding Body Portion

As can be understood from FIG. 3, the gliding body portion 20 of apparatus 5, according to various embodiments, includes a main body panel 30, a fuselage subassembly 40, and an aileron subassembly 60. Reference is also made to FIG. 5; it should be understood that the dotted line DL separating the elements 30 and 60 in FIG. 5 is exemplary, other locations for this dotted line could have been chosen.

As noted above, the gliding body portion 20 "glides", while the disc portion 10 rotates. Thus the main body panel 30, fuselage subassembly 40, and aileron subassembly 60 likewise "glide" while the disc portion 10 rotates. Such members can thus be referenced as "glide" members (e.g., "glide fuselage", etc.). These members are to be contrasted with the relatively rotating members.

In particular embodiments, the gliding body portion 20 is formed of a lightweight, corrugated plastic material. In one embodiment, the lightweight, corrugated plastic material is one of a wide range of extruded twin-wall plastic sheet products produced from a high impact polypropylene copolymer (i.e. Coroplast, or any material commercially available and having substantially similar characteristics). In another embodiment, the gliding body portion 20 is formed of Coroplast. It may be understood that such material includes many of the same characteristics as corrugated paper material, in that it can be cut and folded from a flat blank configuration into a more pronounced three dimensional structure. Reference is now made also to the blank configuration of the gliding body portion 20 shown in FIG. 6.

As can be understood from FIG. 6, the gliding body portion 20 of the apparatus 5, according to various embodiments, is substantially symmetrical with respect to a central plane intersecting the paper of FIG. 6 along longitudinal axis A. As can also be seen in FIG. 6, in particular embodiments, corresponding upwardly extending fin portions 46, rearwardly extending portions 44, and downwardly extending portions 42 (as will be discussed in greater detail later) that form respective portions of the fuselage subassembly 40 are disposed substantially symmetrically with respect to the central axis A. In one embodiment, the upwardly extending fin portions 46 are spaced apart such that the central axis A runs substantially equal distance from each portion.

Main Body Panel

The general function of the main body panel 30 is to provide a connection point for the rotating connection portion 70 to connect the gliding body portion 20 relative to the disc portion 10 as described elsewhere.

In various embodiments, may be understood from for example FIG. 5, the main body panel 30 includes a front edge 34, two side edges 36, and a trailing edge 38. In certain embodiments, the front edge 34 includes two corner edges 35. Each of the two corner edges 35, according to these embodiments, are disposed substantially adjacent a respective one of the two side edges 36. In other embodiments (not shown), the front edge 34 is substantially straight. In still other embodiments (also not shown), the front edge 34 forms an arc between the two side edges 36. As can be understood from both FIGS. 4 and 5, the trailing edge 38 of the main body panel 30, in particular embodiments, is disposed adjacent the aileron subassembly 60. In certain embodiments, the trailing edge 38 is operatively connected to the aileron subassembly 60, while in other embodiments, the main body panel 30 and the aileron portion 60 are formed of a single piece of material.

In various embodiments, as can be seen in FIG. 5, the main body panel 30 is substantially rectangular in shape and includes an opening 32. In certain embodiments, the main body panel 30 is substantially square. In particular embodiments, the opening 32 is disposed substantially adjacent the front edge 34 of the main body panel 30. In one embodiment, the opening 32 is disposed a distance of anywhere between ¾ to 1.5 inches from the front edge 34. In another embodiment, the opening 32 is disposed approximately one inch from the front edge 34. In yet another embodiment, the opening 32 is centrally disposed within the periphery of the main body panel 30.

In various embodiments, as can be seen in FIGS. 5 and 6, the opening 32 of the main body panel 30 is substantially cylindrical-shaped. In certain of those embodiments, the opening 32 has a diameter that is greater than 3/16 of an inch, which serves to prevent rotational drag and/or torque between a central shaft 71 and the main body panel 30 when the former is placed through the opening 32 (as discussed in further detail later). In other of those embodiments, the opening 32 has a diameter of approximately ¼ of an inch. In certain embodiments, the opening 32 is any of a variety of shapes (i.e., square, rectangular, hexagonal, etc.). In various of those embodiments, the opening 32 is greater than 3/16 of inch when measured across the opening 32 in any direction. In other of those embodiments, the opening 32 is approximately ¼ of an inch in size.

In various embodiments, the opening 32 of the main body panel 30 and the centrally disposed opening 15 of the disc portion 10 are substantially the same shape and size. In other embodiments, the two openings 15, 32 are substantially different in shape but substantially the same in size. In certain embodiments, the opening 32, like the centrally disposed opening 15 substantially aligns with the central axis of rotation 12, as best seen in FIGS. 1 and 2. Returning to FIG. 6, according to various embodiments, the opening 32 is disposed substantially on the central axis A of the gliding body portion 20.

Fuselage Subassembly

As shown in FIG. 3, the fuselage assembly 20 extends from the main body panel 30, from two fold lines 40FL, as best shown in FIG. 6.

Also now referring to FIG. 2, according to various embodiments, the fuselage subassembly 40 includes at least two downwardly extending portions 42, at least two rearwardly extending portions 44, and at least two upwardly extending fin portions 46. In certain embodiments, the corresponding downwardly extending portions 42, when folded into a flying configuration, form a substantially "V"-shape.

In other embodiments, the downwardly extending portions 42 may take a variety of shapes, each extending downwardly from the main body panel 30. In various embodiments, the upwardly extending fin portions 46 and the rearwardly extending portions 44 are formed in substantially the same shape (i.e., V-shaped) as the downwardly extending portions 42. In certain embodiments, the various portions may be formed in respectively different shapes other than V-shaped, as desired.

As may be understood from FIGS. 2 and 6, in particular embodiments, the upwardly extending fin portions 46 are longer than the downwardly extending portion 42, such that the upwardly extending fin portion 46 extends above the rim 14 of the disc portion 10 and the downwardly extending portion 42 remains underneath the rim 14 and the concave bottom surface 18 of the disc portion. In certain embodiments, as can also be seen in FIGS. 2 and 6, the upwardly extending fin portions 46 extends above the convex top surface 16 of the disc portion 10. In other embodiments, the upwardly extending fin portions 46 include a tip 48 that protrudes radially inward adjacent the rim 14 of the disc portion 10.

Returning also to FIG. 6, according to various embodiments, the downwardly extending portions 42 are disposed adjacent the rearwardly extending portions 44. In certain embodiments, an end of the rearwardly extending portions 44 spaced from and opposing the end disposed adjacent the downwardly extending portion 42 is disposed substantially adjacent the upwardly extending fin portions 46. In this manner, according to various embodiments, the downwardly extending portions 42, the rearwardly extending portions 44, and the upwardly extending fin portions 48 are disposed adjacent one another so as to form the fuselage subassembly 40. In certain embodiments, the respective portions 42, 44, and 48 are formed from individual pieces of material. In other embodiments, the respective portions are formed from a single piece of material and folded into a desired configuration, such as that depicted in FIG. 2. In these embodiments, the fuselage assembly 40 appears substantially as shown in FIG. 6 when in a pre-folded, "blank" configuration.

Referring now also to FIG. 5, the aileron subassembly 60, according to various embodiments, includes a rearwardly extending aileron body portion 62 and an aileron fin portion 64.

Generally speaking, the aileron body portion 62 is substantially co-planar with the main body panel 30, and extends from the main body panel 30 from the dotted line DL in FIG. 5. As noted above, the dotted line DL separating the elements 30 and 60 in FIG. 5 is exemplary, other locations for this dotted line could have been chosen. The aileron body portion 62 in FIG. 5 is defined by the dotted line DL in FIG. 5, the two angled edges 65, and the dotted fold line 64F.

The aileron fin portion 64 extends from the aileron body portion 64 from the fold line 64F. The aileron fin portion 64 includes a central portion 66 and two side portions 67. Each of the side portions 67 extends laterally from the central portion 66 along corresponding fold lines 67F. Each of the side portions 67 includes a corresponding angled edge 67AE (defined by a corresponding notch 68) which serves as a locating stop during the folding of the aileron fin portion 64 during assembly.

In various embodiments, as best illustrated in FIG. 5, the aileron subassembly 60 includes at least two notches 68 that serve to separate the rearwardly extending portion 62 from the side portions 67 of the aileron fin portion 64. In certain embodiments (such as that shown in FIG. 5), the notches 68 are substantially V-shaped. In other embodiments (not shown), the notches 68 are of any comparable shape that provides a gap between the side portions 67 and the rearwardly extending portion 62. As can be seen by comparing FIG. 5 (aileron fin portion unfolded) and FIG. 4 (aileron fin portion folded), the notches 68 permit the side portions 67 to be moved inward and disposed adjacent the rearwardly extending portion 62 when placed into a folded configuration.

As illustrated in FIG. 4 and FIG. 5, the side portions 67, according to various embodiments, bend along respective fold lines 67F adjacent the central portion 66 when placed into the folded configuration. When placed into the folded configuration, the lower edge of the central portion 66, in particular embodiments, bends adjacent the rearwardly extending portion 62 and along fold line 64FL. The bending of the portions 67, 68, and 66, according to certain of these embodiments, causes the rearwardly extending portion 62 to have what appears to be a three-sided trailing edge.

Returning to FIG. 3, in various embodiments, when placed into the folded configuration, the aileron portion 64 extends in a downwardly angled direction relative to the rearwardly extending portion 62. Upon assembly of the apparatus 5 (as discussed in greater detail later), the aileron portion 64, in certain embodiments, similarly extends in a downwardly angled direction relative to the disc portion 10.

In various embodiments, when folded as previously discussed, the aileron portion 63 is disposed at an aileron angle 69A relative to the rearwardly extending portion 62. In certain embodiments, the aileron angle 69A forms an obtuse angle. In a particular embodiment, the aileron angle 69A is preferably between 135 and 165 degrees. In another embodiment, the aileron angle 69A is preferably approximately 150 degrees. As also understood from FIG. 3, in certain embodiments, the aileron portion 64 is further disposed at a disc angle 19 relative to the concave bottom surface 18 of the disc portion 10. In particular embodiments, the disc angle 19 forms an acute angle. In one embodiment, the disc angle 19 is preferably between 45 and 75 degrees. In another embodiment, the disc angle 19 is preferably approximately 60 degrees. In certain of these embodiments, the sum of the aileron angle 69A and the disc angle 19 is substantially 180 degrees.

Returning to FIG. 4, the side portions 67 of the aileron portion 64 are opposing and spaced apart by at least a length of the central portion 66. In the FIG. 4 embodiment, the side portions 67 are disposed at a side angle 69B relative to the aileron central portion 66. In particular embodiments, the side angle 69B forms an obtuse angle. In a certain embodiment, the side angle 69B is preferably between 135 and 175 degrees. In another embodiment, the side angle 69B is preferably approximately 150 degrees. In certain of these embodiments, the respective side angles 69B formed by the side portions 67 are approximately equal. In still other embodiments (not shown), the respective side angles 69B are substantially unequal.

As seen in FIGS. 3 and 4, the aileron portion 64, when folded as previously discussed, is located adjacent to, but spaced from the rim 14 of the disc portion 10 by a distance 61 when the apparatus 5 is assembled (as discussed in greater detail later). In certain embodiments, the distance 61 is between ¾ of an inch and one and a half inches, which prevents the aileron portion 64 from contacting the rim 14 when the apparatus 5 is in flight. Any such contact would create frictional torque and/or drag that, as previously mentioned, would severely impede the flight characteristics of the apparatus 5. In other embodiments, the distance 61 is preferably approximately one inch.

In one embodiment, the rearwardly extending portion 62, the aileron portion 64, and the main body panel 30 are all formed from a single piece of material (i.e., for example Coroplast, or any lightweight, corrugated plastic material that is one of a wide range of extruded twin-wall plastic sheet products produced from a high impact polypropylene copolymer, as will be discussed in further detail later). If desired however they could be separated, such as is shown later.

Rotating Connection Portion

As noted above, the rotating connection portion 70 holds the two portions 10, 20, together, such that the gliding body portion 20 "glides", while the disc portion 10 rotates. The rotating connection portion 70 has portions that glide, portions that rotate, and intermediate ball bearings that provide a bearing connection between the two portions 10, 20, which preferably provides as little torsional drag between the two members 10, 20 as possible.

Turning to FIG. 7, the rotating connection portion 70, according to various embodiments, includes a central shaft 71, an inner nut 72, and outer nut 73, an upper bearing subassembly 74, and a lower bearing subassembly 87. In certain embodiments, the central shaft 71 is cylindrical in shape and includes a head 71H disposed adjacent an upper end of the shaft. In particular embodiments, the central shaft 71 is elongated and threaded along its entire length. In other embodiments, only a portion of the length of the central shaft 71 is threaded.

When the apparatus 5 is assembled, the central shaft 71 extends through both the upper and lower bearing subassemblies 74, 87, as well as through an opening in the disc portion 10 (shown as opening 15 in FIG. 1, and an opening in the gliding body portion 20 (shown as opening 32 in FIG. 5).

When the inner nut 72, and outer nut 73 are in place as shown in FIG. 7, the lower race element 76 of the upper bearing subassembly 74 is biased against the convex top surface 16 of the disc portion 10, and the upper race element 88 of the lower bearing subassembly 87 is biased against the concave bottom surface 18 of the disc portion 10. The head 71H of the central shaft 71 is biased against the upper surface of the upper race element 75 of the upper bearing subassembly 74, and the body panel 30 of the gliding body portion 20 is gripped relative to the bottom end of the shaft 71 by the inner nut 72, and outer nuts 73. Due to the presence of the ball bearings between the upper and lower races of each bearing subassembly 74, 87, the central shaft 71, the upper race element 75 of the upper bearing subassembly 74, lower race element 89 of the lower bearing subassembly 87, the inner and outer nuts 72, 73, and the body panel 30 of the gliding body portion 20, all rotate together.

Stated another way, the following elements rotate with the disc portion:

- lower race element 76 of the upper bearing subassembly 74; and
- upper race element 88 of the lower bearing subassembly 87; and the following elements "glide" with the gliding body portion 20:
- central shaft 71;
- upper race element 75 of the upper bearing subassembly 74;
- lower race element 89 of the lower bearing assembly 87;
- inner nut 72; and
- outer nut 73.

In various embodiments, the central shaft 71, the inner nut 72, and the outer nut 73 are all formed of Nylon. In particular embodiments, the shaft and inner/outer nuts are formed of any comparable lightweight material as commonly known or commercially available. In certain embodiments, the central shaft 71 comprises a nylon screw (i.e., of the type, for example, 10-32×1¼" Phillips pan head). In other embodiments, the central shaft 71 comprises a nylon screw of comparable size and length. In particular embodiments, the inner nut 72 associated with the central shaft 71 comprises a nylon hex 10-32 nut. In other embodiments, the inner nut 72 comprises a hex nut of a size comparable to that of the central shaft 71. In particular embodiments, the outer nut 73 associated with the central shaft 71 comprises a nylon 10-32 lock nut. In other embodiments, the outer nut 73 comprises a lock nut of a size comparable to that of the central shaft 71 and the inner nut 72.

In various embodiments, a diameter of the central shaft 71 is less than a diameter of the cylindrical shaped opening 15 of the disc portion 10. The difference in diameters provides a space between the central shaft 71 and the disc portion 10, thereby eliminating frictional contact between the two that disrupts the natural flight of the apparatus 5. In certain embodiments, as can be seen in FIG. 9 (and as will be discussed in further detail later), the difference in diameters is approximately 1/16 of an inch.

Upper Bearing Subassembly

The upper bearing subassembly 74, according to various embodiments, includes an upper race element 75, a lower race element 76, a central axis 71A, an upper race central opening 80, a lower race central opening 81, a plurality of ball bearings 82, and at least two grooves 83. In certain embodiments, as shown in FIG. 7, the upper 75 and lower 76 race elements are substantially identical in shape and size. In one embodiment, as shown best in FIG. 1, the upper 75 and lower 76 race elements are substantially circular in shape.

In various embodiments, as best shown in FIG. 8, the upper 75 and lower 76 race elements have a race element radius 79 measured from the central axis 71A of the upper bearing subassembly 74. In a particular embodiment, the race element radius 79 is between ¾ and 1.5 inches. In another embodiment, the race element radius 79 is preferably approximately one inch. In certain embodiments, the race element radii 79 of the upper 75 and the lower 76 race elements are substantially the same. In other embodiments, one of the race element radii 79 is slightly greater in size than the other.

In various embodiments, as best shown in FIG. 8, the upper 75 and lower 76 race elements have a race height 78 of approximately ⅛ of an inch. In certain embodiments, the race height 78 is between ⅛ and 3/16 of an inch. In certain embodiments, the upper 75 and lower 76 race elements are formed from a strong, hard, lightweight plastic material. In particular embodiments, the elements 75, 76 are formed from prefabricated circular blanks having a radius 79 of one inch. In such embodiments, the elements 75, 76 are cut from the prefabricated blanks at the desired height 78. In certain embodiments, the race height 78 is substantially the same for both the upper 75 and the lower 76 race elements. In other embodiments, the race height 78 of one of the race elements is slightly greater in size than the other.

Returning to FIG. 7, according to various embodiments, the plurality of ball bearings 82 are adapted to fit within the grooves 83 of the respective upper 75 and lower 76 race elements. In certain embodiments, the ball bearings 82 are preferably circular in shape and have a diameter of approximately ⅜ of an inch. In particular embodiments, the balls 82 are formed from any one of a variety of strong, hard, lightweight plastic materials. In one embodiment, the balls 82 are formed from a crystalline acetyl plastic. In another embodiment, the crystalline acetyl plastic material comprises Delrin, as commonly known and commercially available. In other embodiments, the crystalline acetyl plastic material comprises any commercially available material having properties substantially similar to those of Delrin.

In particular embodiments, as shown in FIG. 7, the upper 75 and lower 76 race elements include corresponding grooves 83 to accept the ball bearings 82. In particular embodiments, the grooves 83 extend around the circumference of the race elements at a groove radius 86 from the central axis 71A (as discussed in further detail later). In certain embodiments, as best understood in FIG. 8, the grooves 83 have a groove depth 84. In a particular embodiment, the groove depth 84 is preferably approximately 1/16 of an inch. In other embodiments, the groove depth 84 is within a range of 1/16 to 3/32 of an inch.

It has been found by the inventor that the spacing of the ball bearings (whether in the upper or lower race) is in important feature of one of the inventions herein. It has been found that the further the bearing are placed outwardly, the less friction is present in the bearings, and thus less rotational torque is imparted between the disc portion to the body portion. In one embodiment, it has been found that having a race diameter of approximately 1.5 (twice the race or groove radius of approximately 0.75, labeled as 86 in FIG. 8) which has a dimension which is greater than the minimum spacing between the rotating disc portion and the gliding body portion, with in one embodiment is the thickness of the lower bearing, which is approximately ½ (half) inch.

In various embodiments, as also shown in FIG. 8, the grooves 83 have a groove width 85 (i.e. the distance across the face of the groove 83). In a particular embodiment, the groove width 85 is preferably approximately 3/16 of an inch. In various embodiments, the groove width 85 and the groove depth 84 are substantially sized to accept the balls 82. In other embodiments, the groove width 85 and the groove depth 84 for both the upper 75 and the lower 76 race elements are substantially the same size.

In various embodiments, as shown in FIGS. 8 and 9, the grooves 83 are substantially arced such that when placed adjacent one another they form a cavity that is substantially circular in shape. As best understood from FIG. 8, the upper race element 75 and the lower race element 76, according to particular embodiments, are spaced apart by a distance 77 so as to properly accommodate the balls 82. In certain embodiments, the distance 77 is preferably approximately ¼ of an inch. In other embodiments, the size of the balls 82 determines the distance 77 by which the upper 75 and lower 76 race elements are spaced apart.

In various embodiments, as best shown in FIG. 8, the grooves 83 are disposed a groove radius 86 from the center axis 71A of the upper bearing subassembly 74. In certain embodiments, as also evident from FIG. 7, the groove radius 86 is less than the race element radius 79. In a particular embodiment, the groove radius 86 is preferably approximately 25/32 of an inch. In another embodiment, the groove radius 86 is between 19/16 and 15/16 of an inch. In various embodiments, the groove radius 86 of the grooves 83 on the upper 75 and lower 76 race elements are substantially the same so as to properly accommodate the balls 82, as previously discussed.

In various embodiments, the diameter of the balls 82 is less than the groove width 85 of the upper 75 and lower 76 race elements. This difference in diameter allows the balls 82 to freely rotate within the grooves 84 when the apparatus 5 is flying (as will be discussed in further detail later). In certain embodiments, based upon the diameter of the balls 82 and the groove radius 86, at least twenty-four balls 82 are placed within the grooves 83 of the upper 75 and lower 76 race elements. In other embodiments, between twenty and thirty balls 82 are placed within the grooves 83. In each of these embodiments, the number of balls 82 required and the minimum groove radius 86 ensure that the balls 82 freely rotate around the grooves 84 during flight conditions.

In various embodiments, as can be seen from FIG. 9, the upper 75 and lower 76 race elements include respective central openings. The upper race central opening 80 and the lower race central opening 81 are both substantially adapted to receive the central shaft 71. In certain embodiments, the upper race central opening 80 is substantially smaller in size than the lower race central opening 81. In other embodiments (not shown), the upper race central opening 80 and the lower race central opening 81 are both substantially the same in size. In various embodiments, the central openings 80, 81 are both substantially aligned with the central axis 71A of the upper bearing subassembly 74.

According to FIG. 9, in various embodiments, the central openings 80, 81 both have a diameter that is greater than 3/16 of an inch, which serves to prevent rotational drag and/or torque between the central shaft 71 and the upper bearing subassembly 74 when the former is placed through the openings 80, 81 (as discussed in further detail later). In other of those embodiments, the openings 80, 81 have a diameter of approximately ¼ of an inch. In certain embodiments, the openings 80, 81 are any of a variety of shapes (i.e., square, rectangular, hexagonal, etc.). In other embodiments, the openings 80, 81 are substantially circularly-shaped.

In various embodiments, as shown in FIG. 9, the opening 81 is larger than the opening 80, which serves to prevent rotational drag and/or torque, while also allowing a head 71H of the central shaft 71 to operatively engage the upper race element 75. In certain of these embodiments, the opening 81 preferably has a diameter of approximately ¼ of an inch. In other embodiments, the opening 81 has a diameter of ¼ to ⅜ of an inch. In any of these particular embodiments, the opening 80 preferably has a diameter of approximately 3/16 of an inch.

Lower Bearing Subassembly

In general, the lower bearing subassembly 87, according to various embodiments, is substantially identical in structure and operation as the upper bearing subassembly 74 shown in FIGS. 7-9. For purposes of conciseness, FIGS. 7-9 (which depict the upper bearing subassembly 74) will be referred to, by analogy, for purposes of describing the lower bearing subassembly 90. The following is provided to include sufficient detail regarding the lower bearing subassembly 90 to enable one of ordinary skill in the art to make and use the claimed invention.

The lower bearing subassembly 87, according to various embodiments, includes an upper race element 88, a lower race element 89, a central axis 71A, an upper race central opening 93, a lower race central opening 94, a plurality of ball bearings 95, and at least two grooves 96. In certain embodiments, as shown in FIG. 7, the upper 88 and lower 89 race elements are substantially identical in shape and size. In one embodiment, as shown best in FIG. 3, the upper 88 and lower 89 race elements are substantially circular in shape.

In various embodiments, as best shown by analogy to FIG. 8, the upper 88 and lower 89 race elements have a race element radius 92 measured from the central axis 71A of the lower bearing subassembly 87. In a particular embodiment, the race element radius 92 is between ¾ and 1.5 inches. In another embodiment, the race element radius 92 is preferably approximately one inch. In certain embodiments, the race element radii 92 of the upper 88 and the lower 89 race elements are substantially the same. In other embodiments, one of the race element radii 92 is slightly greater in size than the other.

In various embodiments, the upper 88 and lower 89 race elements have a race height 91 of approximately ⅛ inch. In certain embodiments, the race height 91 is between ⅛ and 3/16 inch. In certain embodiments, the upper 88 and lower 89 race elements are formed from a strong, hard, lightweight plastic material. In particular embodiments, the elements 88, 89 are formed from prefabricated circular blanks having a radius 79 of one inch. In such embodiments, the elements 88, 89 are cut from the prefabricated blanks at the desired height 91. In certain embodiments, the race height 91 is substantially the same for both the upper 88 and the lower 89 race elements. In other embodiments, the race height 91 of one of the race elements is slightly greater in size than the other.

Returning to FIG. 7 by analogy, according to various embodiments, the plurality of ball bearings 95 are adapted to fit within the grooves 96 of the respective upper 88 and lower 89 race elements. In certain embodiments, the balls 95 are preferably circular in shape and have a diameter of approximately ⅜ of an inch. In other embodiments, the balls 95 are substantially the same size and shape as the balls 82, as previously discussed.

In particular embodiments, the balls 95 are formed from any one of a variety of strong, hard, lightweight plastic materials. In one embodiment, the balls 95 are formed from a crystalline acetyl plastic. In another embodiment, the crystalline acetyl plastic material comprises Delrin, as commonly known and commercially available. In other embodiments, the crystalline acetyl plastic material comprises any commercially available material having properties substantially similar to those of Delrin.

In particular embodiments, as shown in FIG. 7 by analogy, the upper 88 and lower 89 race elements include corresponding grooves 96 to accept the ball bearings 95. In particular embodiments, the grooves 96 extend around the circumference of the race elements at a groove radius 98 from the central axis 71A (as discussed in further detail later). In certain embodiments, as best understood from FIG. 8, the grooves 96 have a groove depth 97. In a particular embodiment, the groove depth 97 is preferably approximately 1/16 of an inch. In other embodiments, the groove depth 97 is within a range of 1/16 to 3/32 of an inch.

In various embodiments, as also best understood from FIG. 8, the grooves 96 have a groove width 98 (i.e. the distance across the face of the groove 96). In a particular embodiment, the groove width 98 is preferably approximately 3/16 of an inch. In other embodiments, the groove width 98 is within a range of 3/16 to 7/32 of an inch. In various embodiments, the groove width 98 and the groove depth 97 are substantially sized to accept the balls 95. In other embodiments, the groove width 98 and the groove depth 97 for both the upper 88 and the lower 89 race elements are substantially the same size. In still other embodiments, the groove widths 85, 98 and the groove depths 84, 97 are all substantially the same size.

In various embodiments, as shown by analogy to FIGS. 8 and 9, the grooves 96 are substantially arced such that when placed adjacent one another they form a cavity that is substantially circular in shape. As best understood from FIG. 8, the upper race element 88 and the lower race element 89, according to particular embodiments, are spaced apart by a distance 90 so as to properly accommodate the balls 95. In certain embodiments, the distance 90 is preferably approximately ¼ of an inch. In other embodiments, the size of the balls 95 determines the distance 90 by which the upper 88 and lower 89 race elements are spaced apart.

In various embodiments, as best shown by analogy to FIG. 8, the grooves 96 are disposed a groove radius 99 from the center axis 71A of the lower bearing subassembly 87. In certain embodiments, as also evident from FIG. 7, the groove radius 86 is less than the race element radius 79. In a particular embodiment, the groove radius 99 is preferably approximately 25/32 of an inch. In another embodiment, the groove radius 99 is between 19/16 and 15/16 of an inch. In various embodiments, the groove radius 99 of the grooves 96 in the upper race 88 the lower race 89 elements are substantially the same so as to properly accommodate the balls 95, as previously discussed. In other embodiments, the groove radii 99 of the lower bearing subassembly 87 are substantially the same as the groove radii 86 of the upper bearing subassembly 74, as previously discussed.

In various embodiments, the diameter of the balls 95 is less than the groove width 98 of the groove 96. This difference in diameter allows the balls 95 to freely rotate within the grooves 96 when the apparatus 5 is flying (as will be discussed in further detail later). In certain embodiments, based upon the diameter of the balls 95 and the groove radius 99, at least twenty-four balls 95 are placed within the grooves 96 of the upper 88 and lower 89 race elements. In other embodiments, between twenty and thirty balls 95 are placed within the grooves 96. In each of these embodiments, the number of balls 95 required and the minimum groove radius 99 ensure that the balls 95 freely rotate around the grooves 96 during flight conditions. Fewer balls 95 and/or a smaller groove radius 96 create torque and drag between the lower bearing subassembly 87 and the disc portion 10, thereby adversely impacting the flight characteristics of the apparatus 5.

In various embodiments, the number of balls 95 placed within the grooves 96 of the lower bearing subassembly 87 is substantially equal to the number of balls 82 placed within the grooves 83 of the upper bearing subassembly 74. In certain embodiments, the total number of balls 82, 95 contained within the apparatus 5 is forty-eight balls. In other embodiments, the total number of balls 82, 95 ranges from forty to sixty balls. In still other embodiments, the respective number of balls 82 and 95 need not be substantially equal.

In various embodiments, as can be seen by analogy from FIG. 9, the upper 88 and lower 89 race elements include respective central openings. The upper race central opening 93 and the lower race central opening 94 are both substantially adapted to receive the central shaft 71. In certain embodiments, the upper race central opening 93 is substantially smaller in size than the lower race central opening 94. In other embodiments (not shown), the upper race central opening 93 and the lower race central opening 94 are both substantially the same in size. In various embodiments, the central openings 93, 94 are both substantially aligned with the central axis 71A of the lower bearing subassembly 87.

According to FIG. 9, in various embodiments, the central openings 93, 94 both have a diameter that is greater than 3/16 of an inch, which serves to prevent rotational drag and/or torque between the central shaft 71 and the lower bearing subassembly 87 when the former is placed through the openings 93, 94 (as discussed in further detail later). In other of those embodiments, the openings 93, 94 have a diameter of approximately ¼ of an inch. In certain embodiments, the openings 93, 94 are any of a variety of shapes (i.e., square, rectangular, hexagonal, etc.). In other embodiments, the openings 93, 94 are substantially circular in shape. In still other embodiments, the openings 93, 94 are substantially same in size and configuration as the openings 80, 81 associated with the upper bearing subassembly 74.

In various embodiments, as shown by analogy in FIG. 9, the opening 93 is larger than the opening 94, which serves to prevent rotational drag and/or torque, while also allowing an inner 72 and an outer 73 nut to operatively engage the lower race element 89 when the apparatus 5 is fully assembled (as will be discussed in greater detail below). In certain of these embodiments, the opening 93 preferably has a diameter of approximately ¼ of an inch. In other embodiments, the opening 94 has a diameter of ¼ to ⅜ of an inch. In any of these particular embodiments, the opening 93 preferably has a diameter of approximately 3/16 of an inch.

Assembly and General Operation of Apparatus 5

As noted above, the apparatus 5 is assembled by positioning the disc portion relative to the gliding body portion as shown in FIG. 1, and completing the assembly of the rotating connection portion 70, which holds the two portions 10, 20, together. When the apparatus 5 is thrown or otherwise launched in a general direction and the disc portion 10 is given provided with spin or rotation about its central rotational axis (shown as central axis 12 in FIG. 1), the gliding body portion 20 "glides", while the disc portion 10 rotates. This provides a very aesthetically pleasing flight characteristic, which is desirable.

Other Embodiments

Alternative Embodiment 105

FIG. 10A is a bottom view of an apparatus 105, which only includes a disc portion 110 and an aileron subassembly 160, but which does not include a fuselage subassembly. In this figure the gliding body portion 120, including the main body panel 130 and the aileron subassembly 160 (having a downwardly-directed arcuate aileron fin 164, is viewable.

A "positive pressure area" 180 is shown outlined in dotted line in FIG. 10A. The airflow surrounding flying disc apparatuses has been mapped by various methods. In such maps, it has been found that the air pressure and the resulting force of that air pressure is highest in two locations relative to the disc portion 110. These locations are: (1) above and adjacent the leading edge of the disc portion 110 (i.e., toward the direction of flight), and (2) the rear of the cavity formed underneath the disc portion 110 (i.e., 180 degrees from the direction of flight) . In order to have the maximum positive effect on the flight characteristics of the flying toy, placement of the aileron subassembly 160 within the positive pressure area 180 is beneficial. Placement of the aileron subassembly 160 within the positive pressure area 180 thus maximizes the achievable lift for the flying toy (i.e., it improves the flight characteristics significantly).

The positive pressure area 180 is not unique to apparatus 105, it applies to all flying discs discussed herein. In other embodiments having a fuselage subassembly, the placement of the aileron subassembly 160 within the positive pressure area 180 additionally serves to neutralize the extent to which the weight of the fuselage subassembly reduces lift. In essence, while the fuselage subassembly, in certain embodiments, pulls downward on the disc portion 110 by the force of gravity, the aileron subassembly 160 pushes upward by virtue of the angle of the aileron itself and its aerodynamic reaction to the airflow caused by the momentum and velocity of the device. In those embodiments, it is also advantageous for correcting the effect of the weight of the fuselage subassembly if the lift generated by the aileron subassembly is aft of the center of gravity of the flying toy. Since the positive pressure area 180 is located approximately 180 degrees from the path of flight (see FIG. 10A), it is both the highest pressure area and located aft of the center of gravity of the flying toy, thereby making placement of the aileron subassembly 160 in that location of optimal importance, and an important feature of one of the inventions herein.

FIG. 10B illustrates the manner in which the main body panel 130 and the aileron subassembly 160 tend to "cant" (be at an angle relative to) the throwing axis to one side or the other, during the flight of the apparatus 105. It is believed that this "cant" (slightly more clockwise in the left side drawing and slightly more counterclockwise in the right side drawing) is caused by a combination of friction in the rotating connection portion, air flow underneath the flying disc, and the handedness of the thrower (i.e. spin direction of the disc). It is believed that a "wind sock" effect tends to counter the forces causing the cant, said wind sock effect tending to reduce the amount of cant. The curved nature of the arcuate aileron fin 164 is also believed to reduce the effect of interference with rotating airflow underneath the flying disc which is caused by the effect of the rotating disk.

In one embodiment, the arcuate aileron fin 164 extends straight down, that is it has an elongate axis which is substantially parallel to the rotational axis of the disk. In other embodiments, it is at more of an angle such as shown in FIG. 4 or 12.

It should be noted that the canting noted above is more pronounced without the fuselage; the canting is negligible with the fuselage, because the rudder effect (or wind-sock effect) will make the system of fuselage, aileron and rudder align to the overall air flow which tends toward the line of flight. Under the disc, the air is swirling, but when the rudder-based designs are present, it is believed that the swirling has less effect than the air following roughly the path of flight.

Alternative Embodiment 205

FIG. 11 is a bottom view of an additional embodiment apparatus 205, which includes an underside aileron subassembly 260 that is separate from the main body panel 230. The fuselage subassembly 240 is cut away for illustrative purposes. A pin 280 is also shown, which is for maintaining the angle of the aileron subassembly 260 with respect to the main body panel 230. The smaller isolated drawings shows the manner in which slots 290 in the underside aileron subassembly 260 fit around the downwardly-extending walls of the fuselage subassembly 240. The pin can fit through within the corrugated portion of the wall or be on the outside as desired.

Alternative Embodiment 305

FIG. 12 is a side illustrative view of an additional embodiment apparatus 305, illustrating the use of an exemplary aileron subassembly 360, with an additional aileron element 361, which allows for two (or more) ailerons to be used concurrently. It should be understood that this member could be used in combination with other elements such as shown in the apparatus 5, 105, 205, or other embodiments.

Alternative Embodiment 405

FIG. 13 is a side elevational illustrative view of an additional embodiment apparatus 405 illustrating the use of two additional ailerons 460 and, which could be used together or apart. The rear fuselage mounted aileron 460 is mounted to the rear of the fuselage, and can be configured to provide tail lift as needed. The other alternate aileron 461, shaped much like an air foil, could be attached to the top of the assembly, such that it is part of the "gliding" portion of the device. This exemplary wing could have a consistent cross section such as shown in the figure, and have a width as desired. It should be understood that this member could be used in combination with other elements such as shown in the apparatus 5, 105, 205, or other embodiments.

Alternative Embodiment 505

FIG. 14 is a top elevational view of an additional embodiment apparatus 505, which could include a device such as 5 described above, but also includes the use of a forward-mounted "turbulation" member 511, which is essentially "T" shaped, and has multiple protruding ridges 512 molded in its surface to create turbulence and to decrease air pressure on the top. This member is configured to be mounted to the upper race of an upper bearing member in a dual bearing configuration such as shown in FIG. 7, such that the "turbulation" member 311 is part of the "gliding" portion of the device, and is thus kept in the front due to the orientation of the fuselage, which is not shown. If needed, additional tail elements could be added to assure orientation of the fuselage (and the turbulation member).

The multiple protruding ridges 512 could be understood to function similar to the circular ridges that E. E. Headrick patented with respect to the annular ridges presenting the same cross-section to the wind; the rotation is aerodynamically removed from the ridges because they are always presenting the same shape and number to the air. In the multiple protruding ridges 512 design, the ridges are static, but still function to create turbulence and to decrease pressure on the top of the disc portion 510. If attachment mechanisms are added to the upper bearing race of the upper bearing, which can be an important aesthetic feature, there could be a concern that the mechanisms will be in the airflow and cause trouble; so they should be somewhat aerodynamic. Thus, while the mechanism is somewhat aerodynamic in shape, the multiple protruding ridges 512 are also beneficial in that they add more turbulence to the air in that particular location. The inventor also contemplates that such ridges could be decorative, or in further embodiments (not shown) they could be any comparable design as ridges (i.e., cleverly designed windows, spaceship parts, etc.).

Alternative Embodiment 605

FIG. 15 is a top elevational view of an additional embodiment apparatus 605, which could include a device such as 5 described above, but also includes the use of a forward-mounted "canard" member 611, which is configured to be mounted to the upper race of an upper bearing member in a dual bearing configuration such as shown in FIG. 7, such that the "canard" member 611 is part of the "gliding" portion of the device, and is thus kept in the front due to the orientation of the fuselage, which is not shown. If needed, additional tail elements could be added to assure orientation of the fuselage (and the turbulation member). The "canard" member 611 is configured to be bendable as needed, in order to compensate for weight of the device as desired. For example, the leading edge of the "canard" member could be bent downwardly, to cause the canard wing to move downwardly relative to the incoming wind, causing the tail end of the device to rise.

Alternative Embodiment 705

FIG. 16 is an illustrated side view showing a bearing design that includes two fasteners 790, 791, in order to accommodate a top mounted decorative member 711, which can be placed on the top race element 775 of the top bearing subassembly 774. The fuselage subassembly 740 and the top mounted decorative member 711 remain aligned because the fasteners 790, 791 create a single unit, which tend to "glide" together as compared to the rotating races elements 775, 776 attached to the disc portion 710. Note that under this configuration both the upper decorative member 711 and the fuselage may be replaced with other like elements, thus providing an interchangeability feature which could allow for many different customizable appearances. This is yet another significant one the inventions disclosed herein.

Alternative Bearing Design

FIG. 17 is an illustrative side cross sectional view of an alternate bearing design, in which a bearing 720, albeit a double-race bearing, is only on one side of the disc, in this case the underside. This figure shows the disc portion 710, the bearing 720 positioned underneath the disc, and the base 730. A fastener 735 is also shown connecting elements 710, 720. In this configuration the fastener 735 rotates with the flying disc 710.

Alternative Embodiment 805

FIG. 18A is a bottom illustrative view of another embodiment 805 of the invention, which includes a disk 810 rotatably mounted relative to a base member 815, which includes a plurality of rollers 819, which roll within slots provided in the periphery of the flying disc. Small rollers 819 rotate while having their peripheral edges captured and guided within a groove 810G cut or molded around the inside rim of the flying disc. The rollers 819 are mounted to the outward end of radial spokes 817, which extend outwardly from the central portion base member 815. A tail member 820 has tail fins 825 and supports an aileron 821 attached to the tail member, which can fit underneath the flying disc in a manner similar to elements 60, 160, or 260 noted above.

FIG. 18B is a detailed view of a portion of the embodiment 805 described above. It shows the interior annular groove 810G which accepts the edges of the rollers 819, which provide bearing locations. As noted elsewhere in conjunction with the bearing subassemblies 74, 87 of the first described embodiment, it is believed that the movement of the bearing points outwardly provides improved resistance to torque, although there are always counteracting concerns regarding the addition of weight to the device.

Alternative Embodiment 905

FIG. 19A is a top illustrative view of another embodiment 905 including a fan 906 in a disc portion 910, which when placed in the center, provides further lift by driving air from above the top of the disc portion 910 through and to the underneath of the disc, thus providing increased pressure underneath the disc.

FIG. 19B shows the side illustrated view of FIG. 19A. A scoop 907, which is in the "glider" portion of the device, tends to direct air coming in from the front of the device, down passed the rotating fan, which rotates with the flying disc.

The Function and Advantages of the Bearings and the Under-Positioned Ailerons

As may be seen, at least one embodiment described below includes an "underside aileron" but no fuselage. This illustrates how important, in that embodiment and in at least some of the others, that the under-positioned aileron can be. As will also be seen, all of the embodiments include some kind of bearing in order to reduce torsional friction between the rotating and gliding portions of the apparatus. The inventor found that flight characteristics improve as this torsional friction is reduced.

In developing the various embodiments, it was found that the addition of weight to the gliding portion of the device tended to cause it to stall. This "stall problem" was addressed by adding ailerons and wing-type elements as noted elsewhere in this application, therefore off-setting the fuselage weight. However a problem still existed: At the end of the flight the unit tended to turn over counter-clockwise direction for a right-handed thrower, and clockwise for a left-handed thrower.

Although the basic flying-disc had a similar flight path, such yaw was considered by the inventor to be disadvantageously excessive. The inventor found that both air-pressure and gyroscopic precession were affecting the flight of the apparatuses in a negative way. The inventor searched prior art for a 'fix' to this problem, but could not find where the problem of precession had been addressed. The original "Frisbee Flying Disc" had purportedly successfully been altered to off-set the air-pressure problem by an additional patent (U.S. Pat. No. 3,359,678 E. E. Headrick) regarding ridges molded into the upper surface at the point that the curvature is increased approaching the ring that surrounds the concave disc (discussed below). However, such an isolated disk has no attached members, nor the problems introduced by such attached members.

Other prior art, such as U.S. Pat. No. 6,695,666, has central bearings and attempts that might address some aerodynamic issues, but there does not appear to be any attempt in any of the prior art to solve issues related to gyroscopic precession. Additionally, no attempts were apparently made to offset the weight of trailing streamers.

The inventor found that the drag on the central bearing had a direct result on the precession that occurs. The inventor found that this precession is increased as the drag on the central bearing is increased. The inventor have discovered that the precession problem is greatly improved by a low-friction bearing, which bearing will transfer the pull of any attachment to the disc, and any drag will cause a loss of rotational momentum and an increase in gyroscopic precession due to torque.

Disregarding for a moment air pressure, the forces affecting a flying-disc toy are rotation, forward momentum and torque resulting from gyroscopic precession. Bear in mind that the forces on the flying disc are relatively understood, although the fact that the flying disc is in the periphery of aerodynamics means less attention is paid to the factors that influence the flight. The flight of a flying-disc toy usually takes the form of an 'S'. For a right-handed thrower, a flat throw will result in a flight path that takes the following form: upon leaving the thrower, the momentum is at its peak, leading to a reasonably straight flight in the first section; the disc will usually gently turn right (remember, right-handed thrower—reverse directions for a left-handed thrower) then flatten out, and finally turn left. The disc is self-correcting when a large amount of spin and forward momentum are present. However, as the momentum decreases, the forces of air pressure and gyroscopic precession have increasing influence. Air pressure builds up on the side of the disc whose rotation is toward the direction of travel, similar to the forces that affect a tennis ball with spin on it. The air is pushed forward on the side that is moving toward the front. In a flying-disc, this pressure pushes down on the left side (for a right-hand thrower), and thus makes the left side move lower. Since a flying-disc turns by slanting the angle, this means that the disc turns left (left side down, left turn—right side down, right turn).

To lessen this air pressure effect, a series of ridges around the edge of the device set back from the rim at the point of increased air pressure. These ridges purportedly create turbulence, such that this effect decreases air pressure, and the effect of the spin on the air flow is decreased.

In the current design, this effect can be additionally off-set by the location of the aileron that we have been placing on the underside of the disc, thus the term "underside aileron". However, The inventor still wished to correct the gyroscopic precession, which also tilts the disc in the same direction as the air-pressure. Furthermore, the addition of appendages such as lighting, rudders, streamers or any other non-rotating attachments, add weight, which steals momentum, and drag on the rotating disc, which exacerbates the gyroscopic precession.

This is one of the main issues with prior art in this field, and in the research done by the inventors, not addressed by the prior art. By combining air-pressure correction through ailerons, flaps or wings, and reducing the rotational drag by the use of low-friction bearings, these effects can be greatly reduced. Remembering that directional momentum and gyroscopic momentum off-set the precession issues, the flight of a glider-type disc-wing aircraft suffers greatly at the end-of-flight—i.e. the spin rate decreases lowering the gyroscopic momentum, and the forward velocity decreases allowing the air pressure to have more effect (the disc tends to 'ignore' the air pressure when it has enough momentum). The bearings in the present invention consist of low-drag ball-type bearings. It was found that spreading the area of the bearings also improves the flight characteristics. There are two primary reasons for this: The 'post-type' bearings (which consist of a rod through a tubular race) allow too much deformation of the disc surface, and the increased drag adds to the torque, which is undesirable; when the bearing covers more area, the push and pull of additional airframe or decorative elements have less effect on the disc (i.e. when expanded away from the center, the two elements, air-frame and disc work as one, transferring forces and allowing improved control of the flight).

We have proved this by experimentation. Single-post bearings showed increased torque, and the yaw increased substantially. Even when attempts were made to reduce the friction on the post and race type, torque was still unacceptable. Attaching the airframe members to the top and bottom of a central post did little to improve the problem. Ball-bearings showed less torque, and enlarging the bearings (currently 1.5" to 2") showed further improvement, ostensibly by spreading the forces to a larger area of the disc (it is believe this is almost like a gear change—smaller diameter gear=small bearing, large diameter gear=large bearing). There is less deformation, less ability to decrease rotational momentum, and better coordination between the elements.

The shape of the aileron has also been derived by experimentation and/or analysis. The aileron fin can be a simple downturned rectangular panel turned down at an angle from the body panel (such as is the case for the FIG. 12 version), to a more contoured shape still comprised of flat panel sections (e.g. made of Coroplast see FIG. 4), to a more smooth arcuate semicircular shape such as shown in 10A-10B, which might be more suited to plastic molding although various manufacturing processes could be used.

Regarding the curvature, one advantage is to enhance the "wind-sock" effect (the effect of a downwind portion of an element tending to align the element with the wind) of catching air as it comes under the leading edge of the rotating disk. It is also believed that air is better gathered into the center of the aileron fin and thus has more "wind-sock" effect, i.e the force line of the aileron is most likely close to the center because of the funneling of the curved aileron. Furthermore, in working with the "moveable aileron" (the aileron-only version) it was found that the curved or cupped configuration tended to particularly enhance the windsock effect.

To understand the curved design of the aileron, several factors must be kept in mind. The lift requirements regarding torque, as stated elsewhere, become more important as the momentum decreases later in the flight. A properly designed under-side aileron for this device should have a curve which places more area in the airflow that occurs in the concave underside of the disc. Since a right-handed throw results in a counter-clockwise airflow as viewed from the underside, a curved aileron puts more area perpendicular to the flow of air and thus provides more lift. The opposite happens for a left-handed thrower. This is helpful in two primary ways: there is more lift, and the lift-force is greater on the side suffering the most down-force from torque, and down-force from the air flow over top of the disc. If the aileron does not compensate for the spin direction, it will help offset the weight of the fuselage, but will not be as helpful with the tendency of the disc to tip later in flight.

A properly placed, correctly curved underside aileron has a self-compensating effect on the lift requirements. Lift, as referenced elsewhere, is more desirable on the side which is being pushed down by the air on top of the side moving toward the direction of flight. The same side suffers downward forces due to gyroscopic precession. Since the air underneath the disc tends to turn with the disc, the air hits the aileron at an angle. A curved aileron catches this air in a manner that provides correcting force to the disc, and offsets the twisting forces of air pressure on the top (which is greater on the side moving toward the direction of flight), and the gyroscopic precession forces, which unfortunately occur on the same side and in the same direction—down. A properly-placed curved aileron also compensates regardless of the handedness of the thrower, because all forces (excluding gravity), including the aileron's upward force, move to the opposite side of the disc. i.e. the air tends to hit the aileron with more force on the left for a right-handed thrower, and more force on the right for a left-handed thrower. This force is useful and desirable.

It is also important to note that the aileron should not be placed too close to the rim or too far away. The back rim of the disc operates as an aileron as well, and placing the added aileron too close steals the air from the back rim and is counter-productive. Placing the added aileron too far away from the rim moves it out of the high-pressure zone, defeating the purpose.

In one preferred embodiment, the curved aileron has been placed approximately 1.5" away from the rim at all points. However, it could be in the general range of 1-1.5 inches for a 9.5 inch diameter disk, although it should be understood that this figure could be modified upon experimentation. The 3" radius in the HPZ (High-Pressure Zone), is believed to be in the nature of a 3" radius, so 1.5" would be in the center of the HPZ.

Materials

In any of the previously discussed embodiments, the respective portions of the apparatuses are preferably formed from hard, lightweight, plastic materials. In particular embodiments, the disc portions of the various embodiments (i.e., for example disc portion 10 in the first embodiment) are constructed of acrylonitrile butadiene styrene (ABS) plastic. In other embodiments, the disc portions may be constructed as discussed in detail in U.S. Pat. Nos. 3,359,678 and 3,724,122, which are hereby incorporated by reference herein. In still other embodiments, the disc portions may be constructed from a variety of light-weight, hard plastic materials, as commonly known and commercially available.

The body portions of the various embodiments (i.e., for example gliding body portion 20 in the first embodiment) are formed of a lightweight, corrugated plastic material. In one embodiment, the lightweight, corrugated plastic material is one of a wide range of extruded twin-wall plastic sheet products produced from a high impact polypropylene copolymer (i.e. Coroplast, or any material commercially available and having substantially similar characteristics).

In any of the various, previously discussed embodiments, the upper and lower bearing subassemblies, and the plurality of ball bearings found within the various embodiments (i.e., for example, the bearing subassemblies 74, 87 and the balls 82, 95 in the first embodiment) are formed from a strong, hard, lightweight plastic material. In particular embodiments, the bearing subassemblies and the balls are formed from a crystalline acetyl plastic that is very hard and lightweight. In one embodiment, the crystalline acetyl plastic material comprises Delrin, as commonly known and commercially available. In other embodiments, the crystalline acetyl plastic material comprises any commercially available material having properties substantially similar to those of Delrin.

In any of the various, previously discussed embodiments, the central shaft 71, the inner nut 72, and the outer nut 73 are all formed of Nylon. In particular embodiments, the shaft and inner/outer nuts are formed of any comparable lightweight material as commonly known or commercially available. In certain embodiments, the central shaft 71 comprises a nylon screw (i.e., of the type, for example, 10-32×1¼" Phillips pan head). In other embodiments, the central shaft 71 comprises a nylon screw of comparable size and length. In particular embodiments, the inner nut 72 associated with the central shaft 71 comprises a nylon hex 10-32 nut. In other embodiments, the inner nut 72 comprises a hex nut of a size comparable to that of the central shaft 71. In particular embodiments, the outer nut 73 associated with the central shaft 71 comprises a nylon 10-32 lock nut. In other embodiments, the outer nut 73 comprises a lock nut of a size comparable to that of the central shaft 71 and the inner nut 72.

Conclusion

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A flying toy apparatus, said flying toy apparatus when flying along a generally horizontal flight path comprising:

A) a rotating disc portion having including a substantially circular central body portion having a top surface, a bottom surface, and a substantially circular outer periphery, and also including a substantially annular outside rim depending downwardly from said outer periphery and terminating at a substantially circular lower free edge, said disc portion having a substantially vertical central rotational axis, said disc defining a lower cavity defined as underneath said disc portion and above a substantially horizontal plane including said substantially circular lower free edge and being substantially perpendicular to said central rotational axis, said disc portion configured to rotate about said central rotational axis while flying along said generally horizontal flight path such that said rotational axis moves generally along said flight path while remaining generally perpendicular to said flight path;

B) a gliding body portion comprising at least one aileron, said aileron including a downwardly directed aileron fin portion; and C) a rotating connection portion, said rotating connection portion rotatably connecting said disc portion relative to said body portion substantially about said vertical rotational axis, such that at least a portion of said downwardly directed aileron fin portion is within said cavity and defines a generally forwardly-facing surface which is inclined relative to horizontal, and remains forwardly-facing notwithstanding said rotation of said disc portion, said rotating connection portion also including:

1) an upper bearing assembly positioned above said central body portion of said disc portion, said upper bearing assembly itself including an upper race element, a lower race element configured to be attached relative to said central body portion of said disc portion, and intermediate rolling bearing elements between said upper and lower race elements;

2) a lower bearing assembly, positioned below said central body portion of said disc portion, said lower bearing assembly itself including an upper race element configured to be attached relative to said central body portion of said disc portion, a lower race element configured to be attached relative to said gliding body portion, and intermediate rolling bearing elements between said upper and lower race elements; and 3) a connecting rod element configured to connect the following three elements together: a) said upper race element of said upper bearing; b) said lower race element of said lower bearing; and c) said gliding body portion, such that said rotating disc portion can rotated thereto.

2. The flying toy apparatus as claimed in claim 1, further comprising a gliding fuselage attached to said lower race element of said lower bearing.

3. The flying toy apparatus as claimed in claim 1, further comprising a gliding decorative top member attached to said upper race element of said upper bearing.

4. The flying toy apparatus as claimed in claim 2, wherein said gliding fuselage is interchangeable with other gliding fuselages to allow for many different customizable appearances.

5. The flying toy apparatus as claimed in claim 2, wherein said gliding fuselage is interchangeable with other gliding fuselages to allow for many different customizable appearances.

* * * * *